US006941090B2

(12) United States Patent
Uchida et al.

(10) Patent No.: US 6,941,090 B2
(45) Date of Patent: Sep. 6, 2005

(54) DEVELOPING APPARATUS CONFIGURED TO PREVENT SPLASHING OF TONER AND CARRIER

(75) Inventors: Keisuke Uchida, Tokyo (JP); Satoshi Hatori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 67 days.

(21) Appl. No.: 10/460,409

(22) Filed: Jun. 13, 2003

(65) Prior Publication Data

US 2003/0231905 A1 Dec. 18, 2003

(30) Foreign Application Priority Data

Jun. 14, 2002 (JP) ..... 2002-173876

(51) Int. Cl.[7] ..... G03G 15/09

(52) U.S. Cl. ..... 399/98; 399/99; 399/103; 399/267

(58) Field of Search ..... 399/92, 93, 98, 399/102, 103, 267, 273, 275–277

(56) References Cited

U.S. PATENT DOCUMENTS 5,070,812 A * 12/1991 Yamaji ..... 399/275
5,103,765 A * 4/1992 Owada et al. ..... 399/103
5,129,357 A * 7/1992 Yamaji ..... 399/277
5,784,669 A 7/1998 Miura et al.
5,881,338 A * 3/1999 Armstrong et al. ..... 399/98
5,913,092 A 6/1999 Bisaiji et al.
5,915,155 A 6/1999 Shoji et al.
6,122,469 A 9/2000 Miura et al.
6,125,243 A 9/2000 Shoji et al.
6,597,881 B2 7/2003 Hatori et al.

FOREIGN PATENT DOCUMENTS

JP 5-119626 5/1993
JP 10-26861 1/1998
JP 10-247042 9/1998

* cited by examiner

*Primary Examiner*—William J. Royer
(74) *Attorney, Agent, or Firm*—Oblon, Spivak, McClelland, Maier & Neustadt, P.C.

(57) ABSTRACT

A developing apparatus prevents or reduces splashing of toner and carrier caused by abnormal outward airflows generated at downstream positions of a developing unit casing thereof through interactions between behaviors of magnetic brushes and local portions of the developing unit casing. The developing apparatus includes a developer carrying member, a first permanent magnet, a developing unit casing, a second permanent magnet, which is built in the developer carrying member at a fixed position at the downstream side from the first permanent magnet with respect to the rotational direction of the developer carrying member. The developing unit casing has a concave structure to form a low pressure area at a position facing the second permanent magnet. The low pressure area suppresses an increase in the speed of the airflow therein that causes the abnormal outward airflows.

24 Claims, 17 Drawing Sheets

DEVELOPING APPARATUS CONFIGURED TO PREVENT SPLASHING OF TONER AND CARRIER

BACKGROUND OF THE INVENTION

1. Field of the Invention

The present invention generally relates to a magnetic brush development type developing apparatus, an image forming unit and an image forming apparatus.

2. Description of the Related Art

Conventionally, a magnetic brush development type developing apparatus develops a latent image on a photoconductor in the following process. A developing sleeve, which is disposed in an aperture of a developing unit casing, serves as a developer carrying member to form a magnetic field with a permanent magnet thereof. This magnetic field forms a magnetic brush of a two-component developer containing a toner and a carrier. The latent image is developed by the magnetic brush between the photoconductor, which serves as an image carrying member, and the developing sleeve.

FIG. 1 is a front view of a conventional magnetic brush development type developing apparatus for performing the above process. Referring to FIG. 1, a developing sleeve 101 is disposed to closely face a drum-shaped photoconductor 102. The developing sleeve 101 is rotated clockwise, and, in contrast, the photoconductor 102 is rotated counterclockwise. For example, six permanent magnets, three of which are illustrated in FIG. 1 and designated as 103*a*, 103*b*, and 103*c*, respectively, are fixed in a radial pattern in the interior of the developing sleeve 101. Here, the permanent magnet 103*a*, which faces the photoconductor 102 as illustrated, is called a main pole. When the permanent magnet 103*a* creates a magnetic field, the magnetic field forms a magnetic brush of a two-component developer whose components are a toner and a magnetic carrier. The magnetic brush develops a latent image on the photoconductor 102. The permanent magnets other than the main pole permanent magnet 103*a* are called auxiliary poles and are used to form adequate magnetic brushes at the main pole. The developing sleeve 101 is accommodated in a developing unit casing 105. The developing unit casing 105 has an aperture 104 at a position opposite to the photoconductor 102 such that the circumferential surface of the developing sleeve 101 is partially exposed through the aperture 104. As shown in FIG. 1, developer carrying screws 106 and 107 are disposed at the bottom of the developing unit casing 105 such that the developer carrying screws 106 and 107 are located below the developing sleeve 101. The developer carrying screws 106 and 107 work to deliver toners supplied from a toner supplying part, which is not illustrated, to the circumferential surface of the developing sleeve 101 and mix collected toners and supplied developers. Additionally, a doctor blade 108 is provided in the developing unit casing 105 as illustrated. The doctor blade 108 works to maintain the am t of the developer provided to the photoconductor 102 by each magnetic brush at a constant amount.

According to such a conventional magnetic brush development type developing apparatus, however, there is a risk that the toner and the carrier may easily splash from the aperture 104 of the developing unit casing 105. In this case, most of the toner and the carrier fall under the developing apparatus. If the developing apparatus is accommodated in an image forming apparatus such as a copier and a printer, the toner and the carrier are accumulated in the interior of the image forming apparatus and make the interior unclean. In this condition, there are some problems. For instance, if an operator tries to eliminate a paper jam, the operator is likely to dirty his/her hands with the toner or the carrier accumulated in the image forming apparatus. Also, if the toner and the carrier are attached to inner electric parts of the image forming apparatus, there is a risk of noise occurrence. Additionally, if the image forming apparatus is a tandem type full-color image forming apparatus, which has an intermediate transfer belt as a second image carrying member below the photoconductor 102 and the developing apparatus, there is a risk that the splashing toner and carrier fall on the intermediate transfer belt or a transfer paper carried by the intermediate transfer belt.

In order to eliminate the above-mentioned problems, some related art applications are presented below.

Japanese Laid-Open Patent Application No. 05-119626 discloses a developing device that incorporates filters for preventing toner splashes at both ends of an aperture of a developing unit casing thereof.

Additionally, Japanese Laid-Open Patent Application No. 10-026861 discloses a technique that makes use of a phenomenon that splashing of toner and carrier occurs in a contact region (which is referred to as a nip part hereinafter) between a photoconductor and a magnetic brush formed on a developing sleeve. According to the disclosure, carrier collecting means are disposed at a position below the nip part such that the carrier collecting means are separated from the photoconductor and the developing sleeve at respective predetermined intervals.

Additionally, Japanese Laid-Open Patent Application No. 10-247042 discloses a technique for collecting splashing toner and splashing carrier by using airflow caused in a developing apparatus. According to the disclosure, airflow generation means are disposed between a photoconductor and carrier collecting means so as to cause an air to flow from the exterior to the interior of the developing apparatus.

However, the above-mentioned conventional developing apparatuses have some problems. For instance, if the filter or the carrier collecting means are disposed only at ends of a developing unit casing or only at a portion of a developing sleeve so as to prevent the toner splash, toner and carrier can still splash due to airflow from the interior of the developing unit casing, that is, outward airflow. Thus, the above-mentioned conventional techniques cannot sufficiently overcome the toner and carrier splash problems.

In particular, as the conventional developing apparatus operates at higher speeds and the size thereof becomes smaller, the outward airflow becomes more problematic. The generation mechanism of the outward airflow has not been clearly explained. In order to prevent the toner and carrier splash, it is indispensable to demonstrate the generation mechanism and design a developing apparatus that can control the entrance and the exit of the airflow.

Herein, the above-mentioned toner splash problem is investigated in more detail. Although it is known that the toner splash problem is caused by nonuniform developer characteristics, for instance, nonuniformity of the Q/M value where Q represents an amount of electrostatic charge and M represents a toner mass, toner also splashes due to the physical design of the developing apparatus.

A part of the developer carried by the developing sleeve 101 escapes from an electric attractive force with a latent image or a carrier on the photoconductor 102 due to physical contact with the photoconductor 102 and the up-and-down motion of magnetic brushes, and then the escaping developer floats on the airflow in the image forming apparatus.

While the photoconductor 102 and the developing sleeve 101 are rotated, an accompanying airflow arises on the boundary between the surfaces thereof, resulting in the toner being carried along by the airflow. The accompanying airflow hits the developing unit casing 105 at a downstream position with respect to the rotational direction of the developing sleeve 101, or a portion of the accompanying airflow flows out of the developing apparatus there. The separated airflow becomes the above-mentioned outward airflow and causes the floating toner to splash out of the developing unit casing 105. The above-mentioned toner splash mechanism is referred to as the first factor hereinafter. For instance, the above-mentioned developing apparatus according to Japanese Laid-Open Patent Application No. 10-247042 challenges only the first factor.

In addition, there is another factor that has not been conventionally taken into account. This factor focuses attention on viscosity of the air, which cannot be neglected in a small region where a magnetic brush is formed. A mass of air is trapped in an inner space in a plurality of magnetic brushes, and the trapped air passes through a narrow gap between the developing sleeve 101 and the developing unit casing 105. The narrow gap is referred to as a casing gap hereinafter. Although the developer is collected by the developing unit casing 105, the trapped air hits the developing unit casing 105 and is likely to physically cause the toner to flake away. Consequently, the outward airflow is generated from the casing gap. This toner splash mechanism is referred to as the second factor hereinafter.

When the first factor and the second factor are combined, an abnormal outward airflow is generated at the downstream side of the developing unit casing 105. Namely, the interaction between the behavior of magnetic brushes and the portion of the developing unit casing 105 causes the outward airflow from the developing unit casing 105.

Furthermore, the toner splash mechanism due to the second factor is investigated below with reference to FIG. 2 and FIG. 3 in more detail.

FIG. 2 is an enlarged view of a developing part of the conventional magnetic brush development type developing apparatus in FIG. 1. This conventional developing apparatus uses a two-component developer. Referring to FIG. 2, when the permanent magnet 103*a*, which serves as the main pole, is fixed at a position corresponding to the aperture 104 of the developing unit casing 105, a magnetic field due to the main pole forms a magnetic brush 110 of the two-component developer 109. When a latent image on the photoconductor 102 is in contact with the magnetic brush 110, the latent image is developed.

As previously mentioned, toner has the tendency to splash more frequently at the downstream side of the nip part with respect to the rotational direction of the developing sleeve 101.

FIG. 3 is an enlarged view of the downstream side of the nip part wherein the gap between the developing sleeve 101 and the developing unit casing 105 and the height of a magnetic brush 111 are highlighted. In general, the developing apparatus includes the permanent magnets 103*b*,103*c* as the auxiliary poles to maintain the magnetic field in the vicinity of the main pole of the permanent magnet 103*a* that forms the magnetic brush 110 in the contact point between the photoconductor 102 and the developing sleeve 101. As a result, magnetic brushes 111 are also formed at positions corresponding to the auxiliary poles on the developing sleeve 101. However, since the developing unit casing 105, which has the aperture 104 as an end part thereof, is located around the permanent magnet 103*b* at the downstream position of the nip part, the magnetic brush 111 and the developing unit casing 105 can physically interact, for example, a collision can occur between the magnetic brush 111 and the developing unit casing 105.

Referring to FIG. 3, an amount of two-component developer 109 prescribed by the doctor blade 108 is accumulated on the circumferential surface of the developing sleeve 101, resulting in forming the magnetic brush 111 due to the permanent magnet 103*b*. At this time, an air layer 112 of a predetermined height H is trapped in the inner space of the magnetic brush 111 and then is carried to an area 113 on the developing unit casing 105. In particular, if the magnetic brush 111 is formed, a greater amount of air is trapped therein. This phenomenon is caused because the two-component developer 109 includes an extremely fine carrier whose grain diameter is dozens of micrometers and the viscosity of the air has considerable influence. Since the developing unit casing 105 is closed at the inner side from the area 113 and has no outlet for the air, the trapped air has nowhere to go and is released to the exterior of the developing unit casing 105 through the upper side of the magnetic brush 111 as illustrated. The released air becomes an outward airflow 114. The outward airflow 114 can be observed by means of a high-speed camera and an image processing technique.

The outward airflow 114 has the most significant influence on the toner and carrier splash. When the magnetic brush 111 collides with the developing unit casing 105 or the developer carrying screws 106 and 107 mix the two-component developer 109 in the developing unit casing 105, the outward airflow 114 directly blows out floating toner and carrier from the developing unit casing 105.

By using image measuring means to make visible the outward airflow 114, it was observed that the boundary layer (the air layer 112) has the following thicknesses under the conditions as follows;

thickness with the two-component developer 109: 0.07 (mm)

thickness without two-component developer 109: 0.2 (mm)

condition:

diameter of the developing sleeve 101: 60 (mm)

rotational speed of developing sleeve 101: 5 (rad/s)

angle between the nip part and the permanent magnet 103*b*: $\pi/4$ (rad)

The above measurement result shows that the two-component developer 109 traps air on the surface of the developing sleeve 101. In order to eliminate the toner and carrier splash problem, it is necessary to improve such a structure of the developing apparatus where the outward airflow 114 is generated.

SUMMARY OF THE INVENTION

It is a general object of the present invention to provide a developing apparatus, an image forming unit and an image forming apparatus in which the above-mentioned problems are eliminated.

A more specific object of the present invention is to provide a developing apparatus that can prevent or reduce splashes of toner and carrier caused by an abnormal outward airflow generated from a downstream side of a developing unit casing due to the combination with the above-mentioned first and second factors.

In order to achieve the above-mentioned objects, there is provided according to one aspect of the present invention a developing apparatus for developing a latent image on a latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; and a second permanent magnet being built in the developer carrying member at a fixed position near the aperture at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member, wherein the developing unit casing has a concave structure to form a low pressure area at a position facing the second permanent magnet, and the concave structure is concave toward an extension of the second magnetic brush so as to have a larger gap there between the developing carrying member and the developing unit casing than a gap at a tip part of the aperture between the developing carrying member and the latent image carrying member.

According to the above-mentioned invention, since a magnetic brush of an auxiliary pole traps air in the interior thereof around the auxiliary pole due to rising and falling motions thereof, the flow speed of the air increases in a thin air layer in the developing unit casing. However, the developing unit casing has a concave structure, which is concave toward the extension of the magnetic brush, at a position corresponding to the auxiliary pole such that the concave structure is optimized to form an effective low pressure area. In this configuration, it is possible to prevent increase in the flow speed there and suppress an amount of outward airflow that blows toward the aperture of the developing unit casing due to the first and the second factors. As a result, it is possible to prevent splashes of released toner and released carrier.

In the above-mentioned developing apparatus, the concave structure may include a concave part formed on an inner surface of the developing unit casing at a position facing the second permanent magnet.

According to the above-mentioned invention, it is possible to easily implement the above-mentioned developing apparatus by partially processing the developing unit casing.

In the above-mentioned developing apparatus, the concave structure may include a curvature of the developing unit casing.

According to the above-mentioned invention, it is possible to easily implement the above-mentioned developing apparatus by processing the shape of the developing unit casing.

In the above-mentioned developing apparatus, at the position facing the second permanent magnet, a distance between a surface of the developer carrying member and a bottom of the concave structure may be greater than or equal to a height of the second magnetic brush.

According to the above-mentioned invention, even if the distance between the surface of the developer carrying member and the bottom of the concave structure is less than the height of the second magnetic brush, it is possible to obtain the prevention effect on the outward airflow. However, if the distance is set as more than or equal to the height of the second magnetic brush, it is possible to prevent toner and carrier from flaking away from the magnetic brush due to physical impacts such as a collision of the magnetic brush with the inner wall of the developing unit casing. Therefore, it is possible to more effectively prevent splashing of the toner and the carrier.

In the above-mentioned developing apparatus, the developing unit casing may have a passage to communicate between the low pressure area and an exterior of the developing unit casing through a porous breathable sheet.

According to the above-mentioned invention, when the inner pressure of the developing unit casing increases, the developing apparatus can partially release the pressure in the low pressure area in the developing unit casing to the exterior thereof through the passage. Since the porous breathable sheet is disposed on the passage, the developing apparatus can collect toner and carrier that are to splash from the passage by means of the porous breathable sheet. As a result, it is possible to prevent splashing of the toner and the carrier.

In the above-mentioned developing apparatus, the porous breathable sheet may be a high-density polyethylene nonwoven fabric sheet.

According to the above-mentioned invention, if a high-density polyethylene nonwoven fabric sheet is used as the porous breathable sheet, it is possible to improve the capability of collecting toner and carrier. As a result, it is possible to reliably prevent toner splashes and carrier splashes from the passage.

In the above-mentioned developing apparatus, the porous breathable sheet may be disposed such that a surface thereof is not orthogonal to a gravitational direction.

According to the above-mentioned invention, when the developing apparatus is being used in a long time period, splashing toner and splashing carrier tend to be accumulated in the low pressure area in the gravitational direction because of insufficient air evacuation. However, since the porous breathable sheet is disposed such that the sheet surface is not orthogonal to the gravitational direction, it is possible to reduce clogging of the porous breathable sheet due to the accumulation of the toner and the carrier. As a result, it is possible to maintain air permeability over a long time interval.

Additionally, there is provided according to another aspect of the present invention a developing apparatus for developing a latent image on a latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; a second permanent magnet being built in the developer carrying member at a fixed position at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member; a splashing toner inhaling cover being disposed close to the developer carrying member at a downstream side from the first permanent magnet with respect to a rotational direction of the developer carrying member, adjacent to the aperture of the developing unit casing; a splashing toner inhaling duct being disposed below the splashing toner inhaling cover along an axial direction of the developer carrying member and being connected to a ventilator so that air flows in a predetermined direction through the splashing toner inhaling duct, the splashing toner inhaling duct including a narrow part having a smaller diameter; and a plurality of pressure inlet pipes communicating between the splashing toner inhaling duct and the splashing toner inhaling cover at a plurality of positions including a position of the narrow part.

Additionally, the above-mentioned developing apparatus may further include a splashing toner inhaling cover being disposed close to the developer carrying member at a downstream side from the first permanent magnet with respect to a rotational direction of the developer carrying member, adjacent to the aperture of the developing unit casing, a splashing toner inhaling duct being disposed at a downstream position from the splashing toner inhaling cover along an axial direction of the developer carrying member and being connected to a ventilator so that air flows in a predetermined direction through the splashing toner inhaling duct, the splashing toner inhaling duct including a narrow part having a smaller diameter, and a plurality of pressure inlet pipes communicating between the splashing toner inhaling duct and the splashing toner inhaling cover at a plurality of positions including a position of the narrow part.

According to the above-mentioned invention, the developing apparatus can use the splashing toner inhaling cover to collect splashing toner and splashing carrier that blow out of the developing unit casing and then incorporate the collected toner and the collected carrier in airflows that are blowing in the splashing toner inhaling duct in a predetermined direction via the pressure inlet pipes. Also, the splashing toner inhaling duct includes the narrow part having the smaller diameter and some of the pressure inlet pipes are connected to the narrow part. These pressure inlet pipes have lower pressures than those of the pressure inlet pipes connected to the other positions, resulting in stronger inhaling power there. As a result, it is possible to effectively inhale toner and carrier from the narrow part. Hence, it is possible to effectively prevent splashing of the toner and the carrier by devising the shape of the splashing toner inhaling duct and partially strengthening the inhaling power at the narrow part.

In the above-mentioned developing apparatus, at least one of the pressure inlet pipes may communicate between a position of the splashing toner inhaling cover to which one of the toner and the magnetic carrier on the developer carrying member is likely to splash and the narrow part of the splashing toner inhaling duct.

According to the above-mentioned invention, some of the pressure inlet pipes are connected by priority between the narrow part of the splashing toner inhaling duct and positions to which toner and carrier are empirically likely to splash with respect to the axial direction of the developer carrying member, for example, an end part of the developing apparatus and a rib part of the developing unit casing. As a result, it is possible to effectively inhale the toner and the carrier in airflows in the splashing toner inhaling duct.

In the above-mentioned developing apparatus, at least one of the pressure inlet pipes may communicate between a middle position of the splashing toner inhaling cover with respect to the axial direction of the developer carrying member and the narrow part of the splashing toner inhaling duct and at least one of the pressure inlet pipes may communicate between an end position of the splashing toner inhaling cover with respect to the axial direction of the developer carrying member and a thick part of the splashing toner inhaling duct whose diameter is greater.

According to the above-mentioned invention, since it is empirically known that toner splashes are likely to be generated at an end part of the developing apparatus, some of the pressure inlet pipes are provided to communicate between the middle point of the splashing toner inhaling cover with respect to the axial direction and the narrow part of the splashing toner inhaling duct and some of the pressure inlet pipes are provided to communicate between ends of the splashing toner inhaling cover and the thick part of the splashing toner inhaling duct. As a result, pressure differences between the narrow part and the thick part cause an air in the splashing toner inhaling cover to flow from the ends to the middle point. In this configuration, it is possible to shift splashing toner and splashing carrier from the ends of the splashing toner inhaling cover to the middle point and effectively inhale the splashing toner and the splashing carrier in airflows in the splashing toner inhaling duct with minimal use of the pressure inlet pipes.

In the above-mentioned developing apparatus, each of the pressure inlet-pipes may include a first interrupting part separately interrupting communication between the splashing toner inhaling cover and the splashing toner inhaling duct.

According to the above-mentioned invention, if the developing apparatus cannot sufficiently exhibit the expected capability of collecting toner and carrier depending on conditions of an image forming apparatus in which the developing apparatus is installed, it is possible to modify airflows to collect the toner and the carrier after installation by switching connection conditions of the pressure inlet pipes or selecting the pressure inlet pipes by the interrupting part.

Additionally, the above-mentioned developing apparatus may further include a second pressure inlet pipe communicating between the narrow part of the splashing toner inhaling duct and the passage, and a second interrupting part interrupting communication between the splashing toner inhaling duct and the passage.

According to the above-mentioned invention, while the developing apparatus is not used, the second interrupting part opens the second pressure inlet pipe so as to communicate between the narrow part of the splashing toner inhaling duct and the passage. As a result, it is possible to force outward airflows to blow in the low pressure area by changing the air in the low pressure area to positive pressure with respect to the atmosphere. The developing apparatus can collect toner and carrier accumulated on the porous breathable sheet in the splashing toner inhaling duct via the splashing toner inhaling cover because of the forced outward airflows. Accordingly, it is possible to maintain the function of the porous breathable sheet for a long time period.

Additionally, there is provided according to another aspect of the present invention an image forming unit, including: a latent image carrying member on which a latent image is formed; and a developing apparatus developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; and a second permanent magnet being built in the developer carrying member at a fixed position near the aperture at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member, wherein the developing unit casing has a concave structure to form a low pressure area at a position facing the second permanent magnet, and the concave structure is concave toward an extension of the second magnetic brush so as to have a larger gap there between the developing carrying member and the developing unit casing than a gap at a tip part of the aperture between the developing carrying member and the latent image carrying member.

Additionally, there is provided according to another aspect of the present invention an image forming unit, including: a latent image carrying member on which a latent image is formed; and a developing apparatus developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; a second permanent magnet being built in the developer carrying member at a fixed position at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member; a splashing toner inhaling cover being disposed close to the developer carrying member at a downstream side from the first permanent magnet with respect to a rotational direction of the developer carrying member, adjacent to the aperture of the developing unit casing; a splashing toner inhaling duct being disposed below the splashing toner inhaling cover along an axial direction of the developer carrying member and being connected to a ventilator so that air flows in a predetermined direction through the splashing toner inhaling duct, the splashing toner inhaling duct including a narrow part having a smaller diameter; and a plurality of pressure inlet pipes communicating between the splashing toner inhaling duct and the splashing toner inhaling cover at a plurality of positions including a position of the narrow part.

According to the above-mentioned invention, it is possible to provide an image forming unit that can make use of the advantages of the above-mentioned developing apparatus.

Additionally, there is provided according to another aspect of the present invention an image forming apparatus, including: a latent image carrying member being rotationally driven; an optical writing part forming a latent image on the latent image carrying member; and a developing apparatus being disposed near the latent image carrying member, the developing apparatus developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; and a second permanent magnet being built in the developer carrying member at a fixed position near the aperture at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member, wherein the developing unit casing has a concave structure to form a low pressure area at a position facing the second permanent magnet, and the concave structure is concave toward an extension of the second magnetic brush so as to have a larger gap there between the developing carrying member and the developing unit casing than a gap at a tip part of the aperture between the developing carrying member and the latent image carrying member.

Additionally, there is provided according to another aspect of the present invention an image forming apparatus, including: a latent image carrying member being rotationally driven; an optical writing part forming a latent image on the latent image carrying member; and a developing apparatus being disposed near the latent image carrying member, the developing apparatus for developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; a second permanent magnet being built in the developer carrying member at a fixed position at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member; a splashing toner inhaling cover being disposed close to the developer carrying member at a downstream side from the first permanent magnet with respect to a rotational direction of the developer carrying member, adjacent to the aperture of the developing unit casing; a splashing toner inhaling duct being disposed below the splashing toner inhaling cover along an axial direction of the developer carrying member and being connected to a ventilator so that air flows in a predetermined direction through the splashing toner inhaling duct, the splashing toner inhaling duct including a narrow part having a smaller diameter; and a plurality of pressure inlet pipes communicating between the splashing toner inhaling duct and the splashing toner inhaling cover at a plurality of positions including a position of the narrow part.

According to the above-mentioned invention, it is possible to provide an image forming apparatus that can make use of the advantages of the above-mentioned developing apparatus.

Additionally, there is provided according to another aspect of the present invention an image forming apparatus, including: an image forming unit, including: a latent image carrying member on which a latent image is formed; and a developing apparatus developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; and a second permanent magnet being built in the developer carrying member at a fixed position near the aperture at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member; and an optical writing part forming the latent image on the latent image carrying member, wherein the developing unit casing has a concave structure to form a low pressure area at a position facing the second permanent magnet, and the concave structure is concave toward an extension of the second magnetic brush so as to have a larger gap there between the developing carrying member and the developing unit casing than a gap at a tip part of the aperture between the developing carrying member and the latent image carrying member.

Additionally, there is provided according to another aspect of the present invention an image forming apparatus, including: an image forming unit, including: a latent image carrying member on which a latent image is formed; and a developing apparatus developing the latent image on the latent image carrying member with a magnetic brush made of developer comprising toner and magnetic carrier, including: a developer carrying member being rotated in a state where the magnetic brush is being formed thereon so as to develop the latent image; a first permanent magnet being built in the developer carrying member at a fixed position facing the latent image carrying member, the first permanent magnet serving as a main pole and generating a magnetic field of the main pole so as to form a first magnetic brush of the developer on the developer carrying member; a developing unit casing covering the developer carrying member, the developing unit casing having an aperture to expose the developer carrying member at the position facing the latent image carrying member; a second permanent magnet being built in the developer carrying member at a fixed position at a downstream side from the first permanent magnet with respect to a rotational direction of the developer carrying member, the second permanent magnet serving as an auxiliary pole and generating a magnetic field of the auxiliary pole so as to form a second magnetic brush of the developer on the developer carrying member; a splashing toner inhaling cover being disposed close to the developer carrying member at a downstream side from the first permanent magnet with respect to a rotational direction of the developer carrying member, adjacent to the aperture of the developing unit casing; a splashing toner inhaling duct being disposed below the splashing toner inhaling cover along an axial direction of the developer carrying member and being connected to a ventilator so that air flows in a predetermined direction through the splashing toner inhaling duct, the splashing toner inhaling duct including a narrow part having a smaller diameter; and a plurality of pressure inlet pipes communicating between the splashing toner inhaling duct and the splashing toner inhaling cover at a plurality of positions including a position of the narrow part; and an optical writing part forming the latent image on the latent image carrying member.

According to the above-mentioned invention, it is possible to provide an image forming apparatus that can make use of the advantages of the above-mentioned developing apparatus.

In the above-mentioned image forming apparatus may further include a plurality of the latent image carrying members, a plurality of the developing apparatuses, and a tandem type image carrying member on which a plurality of developed images on the latent image carrying members are sequentially transferred.

According to the above-mentioned invention, it is possible to provide an image forming apparatus that can make use of the advantages of the above-mentioned developing apparatus. In particular, it is possible to prevent splashing and attaching of toner and carrier on the image carrying member and, therefore, to provide a color image forming apparatus that can form a color image without any spot.

Other objects, features and advantages of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

A description will now be given, with reference to FIG. 4 through FIG. 9, of a developing apparatus according to the first embodiment of the present invention. The developing apparatus is applied to a magnetic brush development type developing apparatus using a two-component developer. Such a magnetic brush development type developing apparatus is typically adopted to an electrophotographic type printer.

Figure 1:
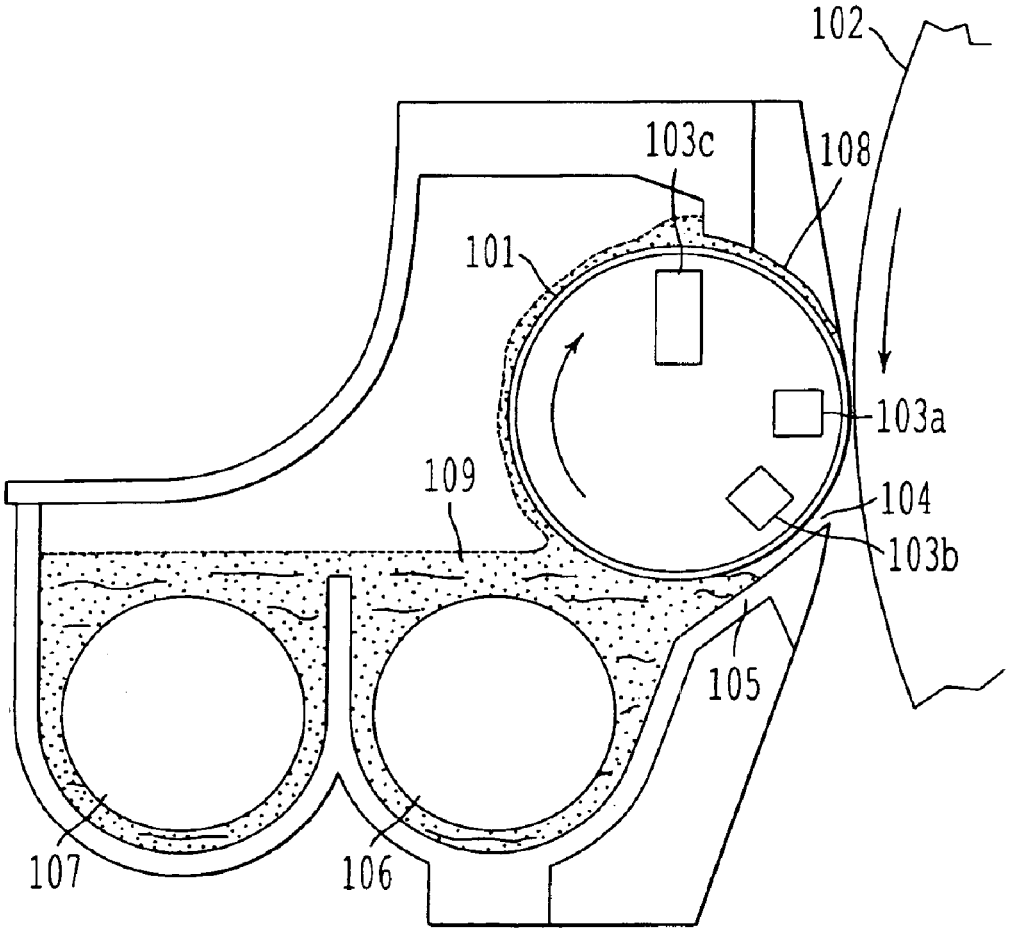
FIG. 1 PRIOR ART
FIG. 1 is a cross-sectional front view of a conventional magnetic brush development type developing apparatus for developing a latent image on a photoconductor by a magnetic brush.
Figure 4:
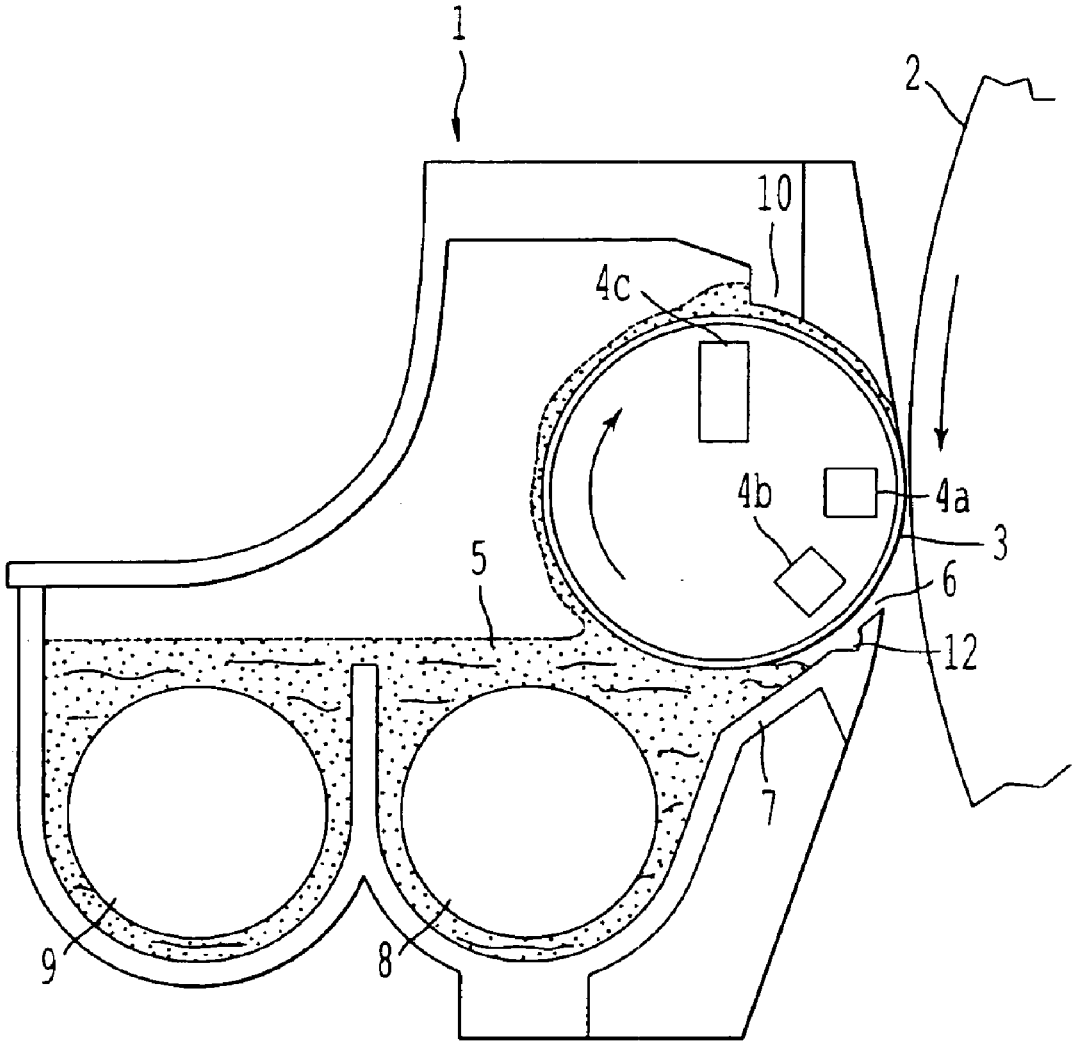
FIG. 4 is a cross-sectional front view of a developing apparatus according to a first embodiment of the present invention.

FIG. 4 is a front view of a developing apparatus 1 according to the first embodiment wherein the developing apparatus 1 has a fundamental structure similar to that in FIG. 1. In the developing apparatus 1, a developing sleeve 3 is disposed to closely face a drum-shaped photoconductor 2. The developing sleeve 3 is rotationally driven clockwise and serves as a developer carrying member. The photoconductor 2 is rotationally driven counterclockwise and serves as a latent image carrying member. The developing sleeve 3 is formed of a nonmagnetic material such as aluminum, brass, stainless steel and conductive resin in cylindrical shape. A plurality of permanent magnets 4*a*, 4*b*, 4*c* (for example, six permanent magnets) are radially fixed in the developing sleeve 3. In particular, the permanent magnet 4*a* that faces the photoconductor 2 is referred to as a main pole (or a developing magnetic pole). The permanent magnet 4*a* forms a magnetic brush in such a way that a magnetic field thereof attracts particles of the two-component developer 5 composed of a toner and a magnetic carrier, and the formed magnetic brushes develop a latent image on the photoconductor 2. On the other hand, the other permanent magnets 4*b*, 4*c* are used to properly form magnetic brushes in the vicinity of the main pole and are referred to as auxiliary poles (or carrying magnetic poles). The developing sleeve 3 is enclosed by a developing unit casing 7. The developing unit casing 7 has a pursed aperture 6 for exposing the developing sleeve 3 only in a region facing the photoconductor 2. In the developing unit casing 7, toner carrying screws 8 and 9 are disposed in the lower-side space in the developing unit casing 7 with respect to the location of the developing sleeve 3. The toner carrying screws 8 and 9 deliver toner from a (not illustrated) toner supplying part to the circumferential surface of the developing sleeve 3 and mix collected toner and the magnetic carrier. Additionally, a doctor blade 10 is provided in the developing unit casing 7. The doctor blade 10 controls the amount of the two-component carried 5 to the photoconductor 2.

Figure 5:
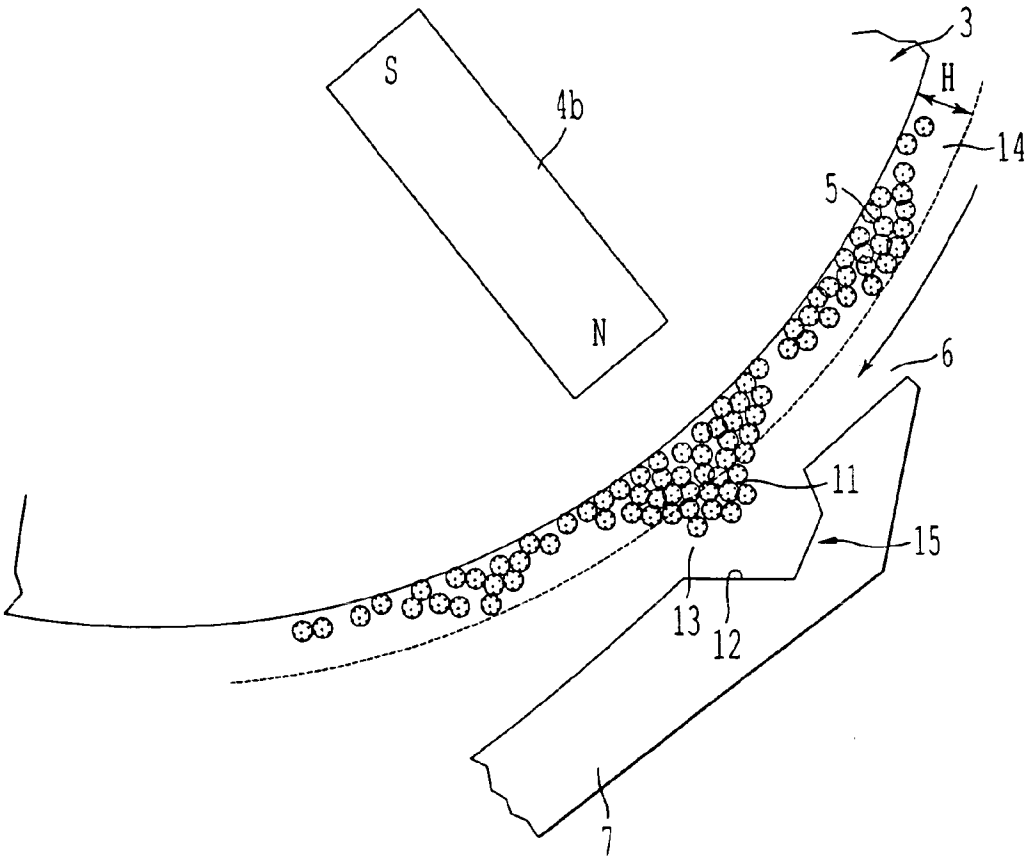
FIG. 5 is a cross-sectional front view of a developing part of the developing apparatus according to the first embodiment.

FIG. 5 is an enlarged view of a developing part of the developing apparatus 1. Referring to FIG. 5, the developing apparatus 1 includes the permanent magnet 4*b* as an auxiliary pole at a position near the aperture 6 in the downstream side from the permanent magnet 4*a* with respect to the rotational direction of the developing sleeve 3, for instance, a position at 45° with respect to a nip part, which is the contact area between the photoconductor 2 and magnetic brushes on the developing sleeve 3. The developing unit casing 7 includes a concave part 12 at an inner region thereof opposite to the permanent magnet 4*b* as shown in FIG. 5. The concave part 12 has a concave structure 15 oriented toward the projection direction of a magnetic brush 11 formed by the permanent magnet 4*b*. The developing unit casing 7 is configured such that the developing unit casing 7 extends toward the nip part and the aperture 6 is narrowed along the circumferential surface of the developing sleeve 3 as illustrated. Furthermore, the concave part 12 is formed to have a space to increase the distance between the circumferential surface of the developing sleeve 3 and the inner wall of the developing unit casing 7. The concave part 12 may be formed by partially cutting the developing unit casing 7. Also, after a region corresponding to the location of the concave part 12 is deepened so as to penetrate to the exterior of the developing unit casing 7, the concave part 12 may be formed by covering the penetrating portion from the exterior with a cover. The concave part 12 may have a cone shape as illustrated or other concave shapes such as an arc shape.

Also, the developing unit casing 7 has two sidewalls, which are not illustrated in FIG. 4, for covering both ends of the developing sleeve 3 with respect to the axial directions thereof, that is, both sides of the developing apparatus 1. In such configuration, both side walls, the concave part 12 and the surface of the developing sleeve 3 enclose an area, which is referred to as a low pressure area 13.

The developing unit casing 7 is configured such that the inner wall thereof has a concavity at a position corresponding to the magnetic brush 11 formed by the permanent magnet 4*b* serving as an auxiliary pole. The magnetic brush 11 is formed in the low pressure area 13 corresponding to the concave part 12. As mentioned above, when the magnetic brush 11 incorporates air in the inner space thereof around the permanent magnet 4*b* through up-and-down motions thereof, the incorporation increases the flow speed of a thin air layer 14 in the developing unit casing 7. According to the developing apparatus 1, since the concave part 12 and the low pressure area 13 are formed at the position corresponding to the permanent magnet 4*b*, it is possible to prevent an increase in the airflow speed and thereby reduce the amount of outward airflow from the developing unit casing 7. As a result, i s possible to suppress splashes of toner and carrier.

Instead of the concave part 12, the developing unit casing 7 may have an aperture 6 that is fully opened by a space between the portion corresponding to the concave part 12 and the tip of the developing unit casing 7. However, although such a structure performs well in reducing the amount of outward airflow, the wider aperture 6 increases the amount of carrier dropping from the aperture 6. In this case, the developing unit casing 7 cannot play the inherent casing (enclosing) role. Therefore, it is necessary to design the developing apparatus 1 such that the end part (the aperture 6) of the developing unit casing 7 is located as close to the developing sleeve 3 as possible.

Figure 6B:
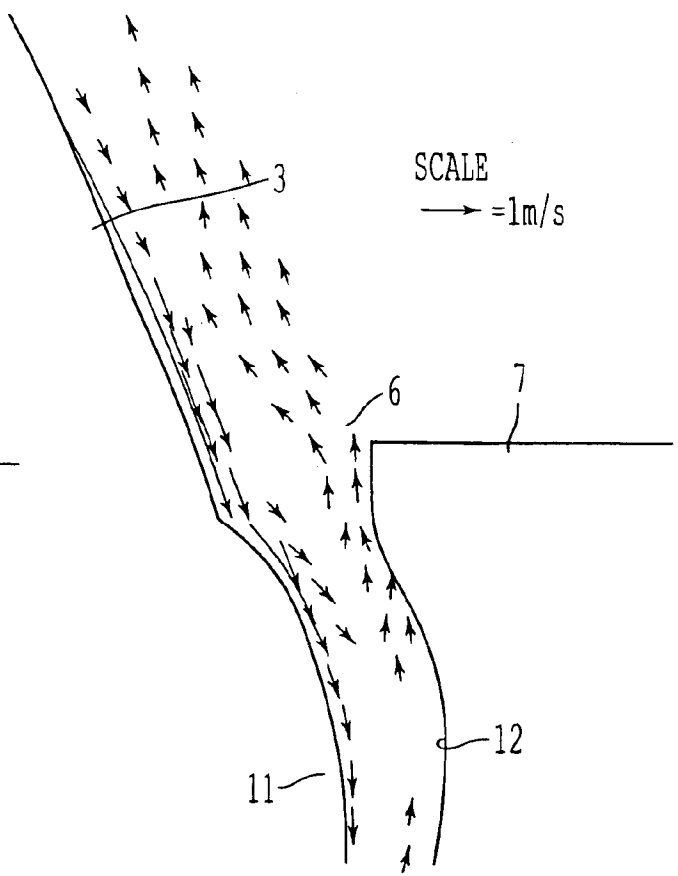
FIG. 6B is a diagram illustrating a measurement result of outward airflows in the vicinity of a magnetic brush formed by an auxiliary pole of the developing apparatus having a concave part according to the first embodiment.
Figure 6A:
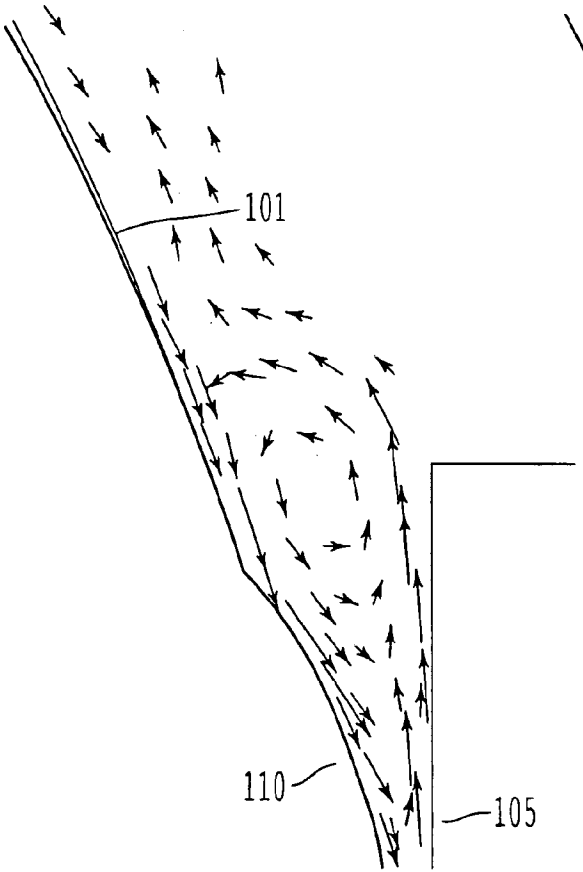
FIG. 6A PRIOR ART
FIG. 6A is a diagram illustrating a measurement result of outward airflows in the vicinity of a magnetic brush formed by an auxiliary pole of a conventional developing apparatus having no concave part.

FIGS. 6A and 6B show measurement results of airflows in the vicinity of the magnetic brushes 110 and 11, respectively, formed by respective auxiliary poles of two developing apparatuses by using measuring equipment such as a high-speed camera. In FIG. 6A, the developing apparatus comprises a conventional developing unit casing 105 having no concave part. In FIG. 6B, the developing apparatus comprises the developing unit casing 7 having the concave part 12. Here, the measurements were conducted under the following conditions;

drum diameter: 60 mm line speed: 2 m/s head speed of magnetic brush: 6 m/s.

In FIGS. 6A and 6B, flow speeds of the airflows are represented as lengths of illustrated lines.

Figure 7B:
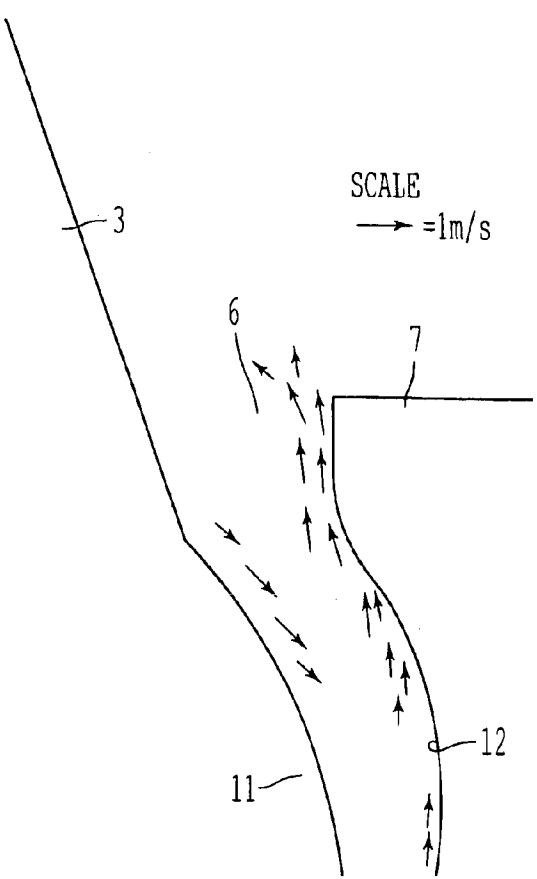
FIGS. 7A and 7B are schematic diagrams for explaining the measurement results shown in FIGS. 6A and 6B, respectively.
Figure 7A:
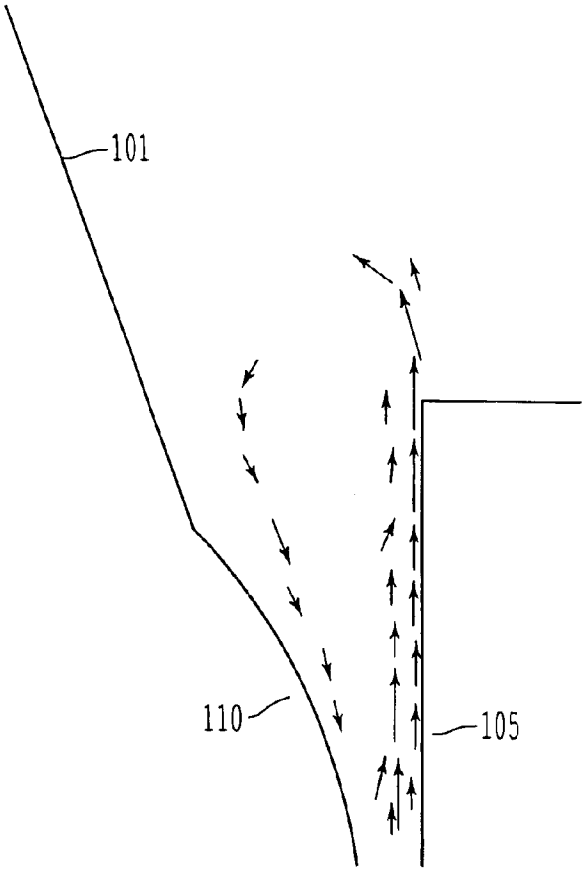
FIG. 7A PRIOR ART

FIGS. 7A and 7B are schematic diagrams for explaining the measurement results shown in FIGS. 6A and 6B, respectively. In FIGS. 7A and 7B, the airflows flow in directions pointed to by illustrated arrows, and the speeds thereof are represented by the lengths of the arrows.

As shown in FIGS. 6A through 7B, if the developing unit casing 7 has the concave part 12 oriented toward the magnetic brush 11, the outward airflows from the interior of the developing unit casing 7 have quite lower flow speeds than those in the conventional developing unit casing without the concave part 12. According to the measurement results, it can be observed that the developing apparatus 1 has the structure that the airflows reduce the problem of splashing of toner and carrier because of the lower flow speeds. If the space between the developing unit casing 7 and the magnetic brush 11 is made narrower, the airflows are also forced to flow through a narrower flow path. As a result, the flow speeds increase, and the faster airflows exit from the developing unit casing 7 in a state where momentums thereof are maintained. For this reason, the developing apparatus 1 can effectively prevent splashing of toner and carrier compared to the conventional developing apparatus having no concave part. Here, although the head speed of the magnetic brush 11 varies depending on the amount of supplied developer, the above-mentioned tendency of the airflows persists.

Figure 8:
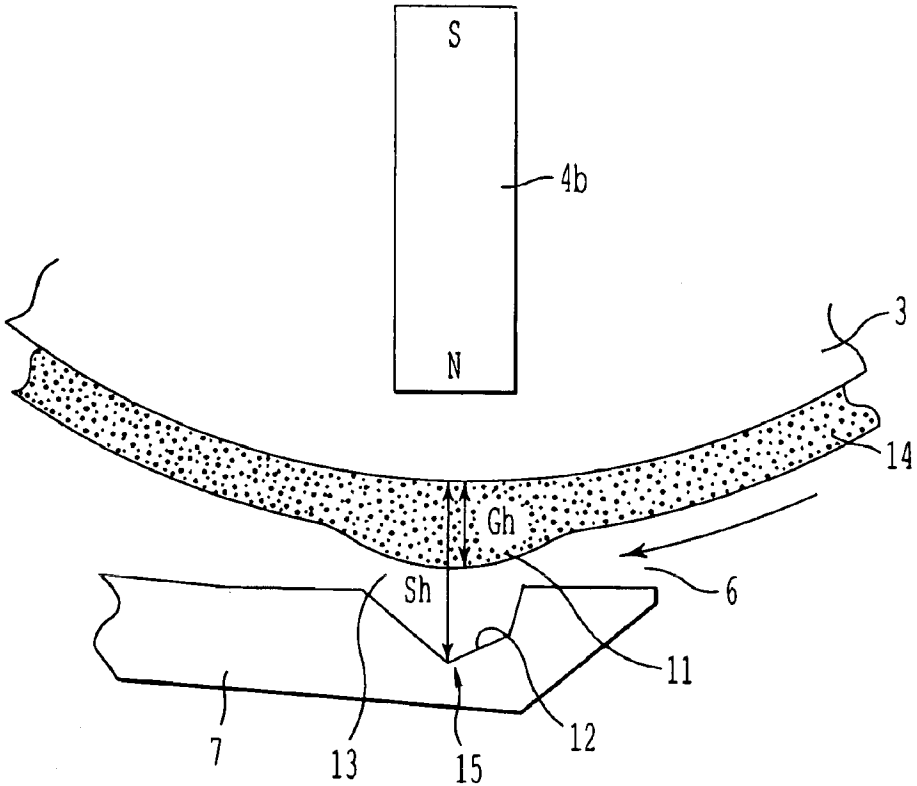
FIG. 8 is an enlarged cross-sectional front view schematically illustrating the concave part with respect to a depth thereof.

FIG. 8 is an enlarged view schematically illustrating the concave part 12 with respect to a depth thereof wherein the length Gh represents the distance between the head of the magnetic brush 11 formed by the permanent magnet 4*b* and the surface of the developing sleeve 3 (the height of the magnetic brush 11) and the length Sh represents the distance between the surface of the developing-sleeve 3 and the bottom of the concave part 12. Fundamentally, even if Gh>Sh, the concave part 12 maintains the preferable effects on the outward airflow. In this case, however, the magnetic brush 11 hits the side wall and other parts of the developing unit casing 7, and there is a high probability that toner and carrier can flake away from the magnetic brush 11 due to the physical impact. Meanwhile, if the concave part 12 is configured such that Gh≦Sh as shown in FIG. 8, it is possible to not only prevent the flaking of the toner and the carrier due to physical impact but also suppress the splashing of the toner and the carrier due to the outward airflow.

Figure 9:
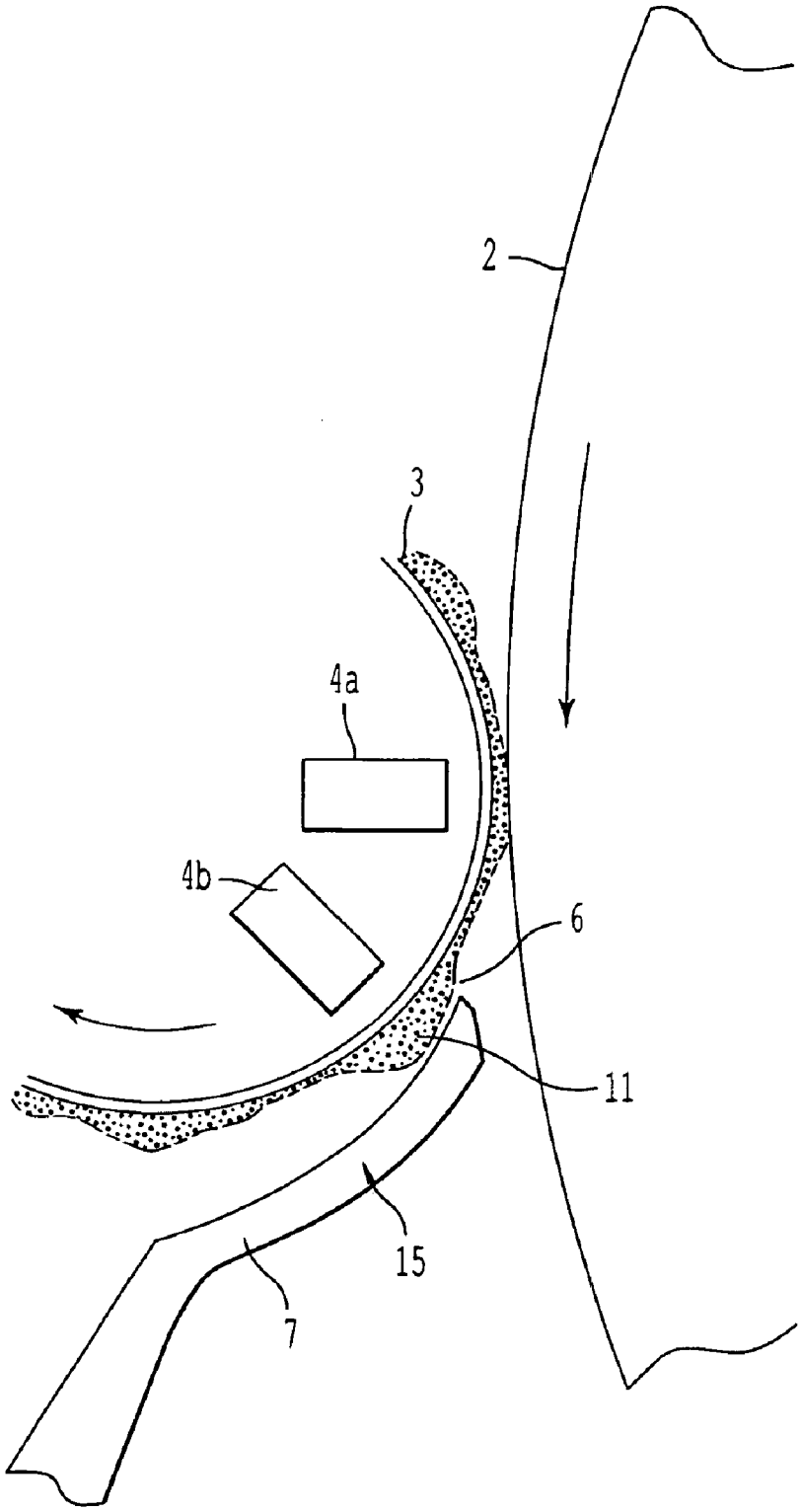
FIG. 9 is an enlarged cross-sectional front view of a variation of the developing part of the developing apparatus according to the first embodiment.

Here, although the developing unit casing 7 is configured to have the concave structure 15 in accordance with the concave part 12, the concave structure 15 may be formed as a curvature in which a portion of the developing unit casing 7 opposite to the permanent magnet 4*b* is curved toward the exterior thereof as shown in FIG. 9.

A description will now be given, with reference to FIG. 10, of a developing apparatus according to the second embodiment of the present invention wherein the same parts as those of the developing apparatus according to the first embodiment are designated by the same reference numerals and a description thereof is omitted.

Figure 10:
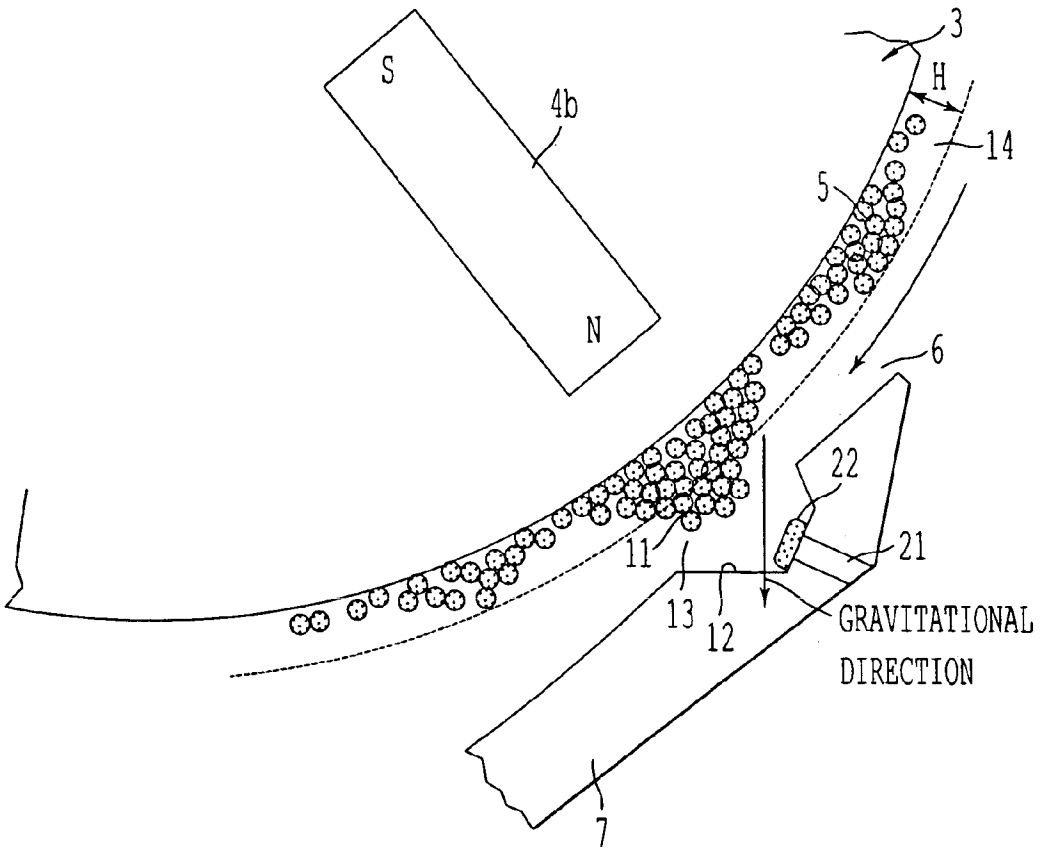
FIG. 10 is a cross-sectional front view of a developing part of a developing apparatus according to a second embodiment of the present invention.

In the developing apparatus according to the second embodiment, a plurality of passages 21 are disposed at positions in the surface side of the concave part 12 facing outward airflows as illustrated in FIG. 10 such that the passages 21 pierce through the developing unit casing 7 in the horizontal direction. The passages 21 serve to communicate between the low pressure area 13 and the exterior of the developing unit casing 7. Additionally, a porous breathable sheet 22 is provided at the surface side of the concave part 12 where the passages 21 are disposed.

When the developing apparatus 1 has such a structure, it is possible to suppress the outward airflows by partially releasing rising inner pressure in the low pressure area 13 via the passages 21. At the same time, since the porous breathable sheet 22 is provided at the passages 21 that serve as an interface with the exterior of the developing unit casing 7, the porous breathable sheet 22 is able to collect toner and carrier that can blow out via the passages 21. As a result, it is possible to prevent the toner and carrier splashes by using the passages 21.

Here, it is preferable that the porous breathable sheet 22 be a high-density polyethylene nonwoven fabric sheet. Specifically, it is preferable that the high-density polyethylene nonwoven fabric sheet have an average pore size sufficiently smaller than the average toner grain diameter. For instance, if the average grain diameter is 5 μm, the average pore size should be set as less than 3 μm. When such a high-density polyethylene nonwoven fabric sheet is adopted in the developing apparatus 1, it is possible to with greater assurance collect not only toner but also carrier.

Additionally, when toner and carrier are insufficiently removed from the low pressure area 13 due to inadequate orientations of the passages 21 and the porous breathable sheet 22, there is a tendency for the toner and the carrier to accumulate in the gravitational direction during long term use of the developing apparatus 1. If the passages 21 were to be oriented at the bottom of the concave part 12 parallel to the gravitational direction and the porous breathable sheet 22 were to be disposed on the passages 21, the toner and the carrier would be consequently accumulated on the porous breathable sheet 22. As a result, the porous breathable sheet 22 would be clogged over time and would not be able to exert adequate air permeability. Thus, it would become impossible to achieve the originally intended effect of decreasing the air pressure in the low pressure area 13. In order to overcome this problem, it is preferable that the passages 21 be formed such that the passages 21 are not oriented parallel to the gravitational direction, for instance, as illustrated by the arrow in FIG. 10. Also, it is preferable that the porous breathable sheet 22 be provided on the passages 21 such that the sheet surface of the porous breathable sheet 22 is not orthogonal to the gravitational direction. When the developing apparatus 1 has such a structure, it is possible to delay the clog time due to accumulation of toner and carrier and maintain the effect of decreasing the air pressure in the low pressure area 13 for a longer period.

A description will now be given, with reference to FIG. 11 and FIG. 12, of a developing apparatus 1 according to the third embodiment of the present invention wherein the same parts as those of the developing apparatuses according to the previous embodiments are designated by the same reference numerals and a description thereof is omitted.

Figure 11:
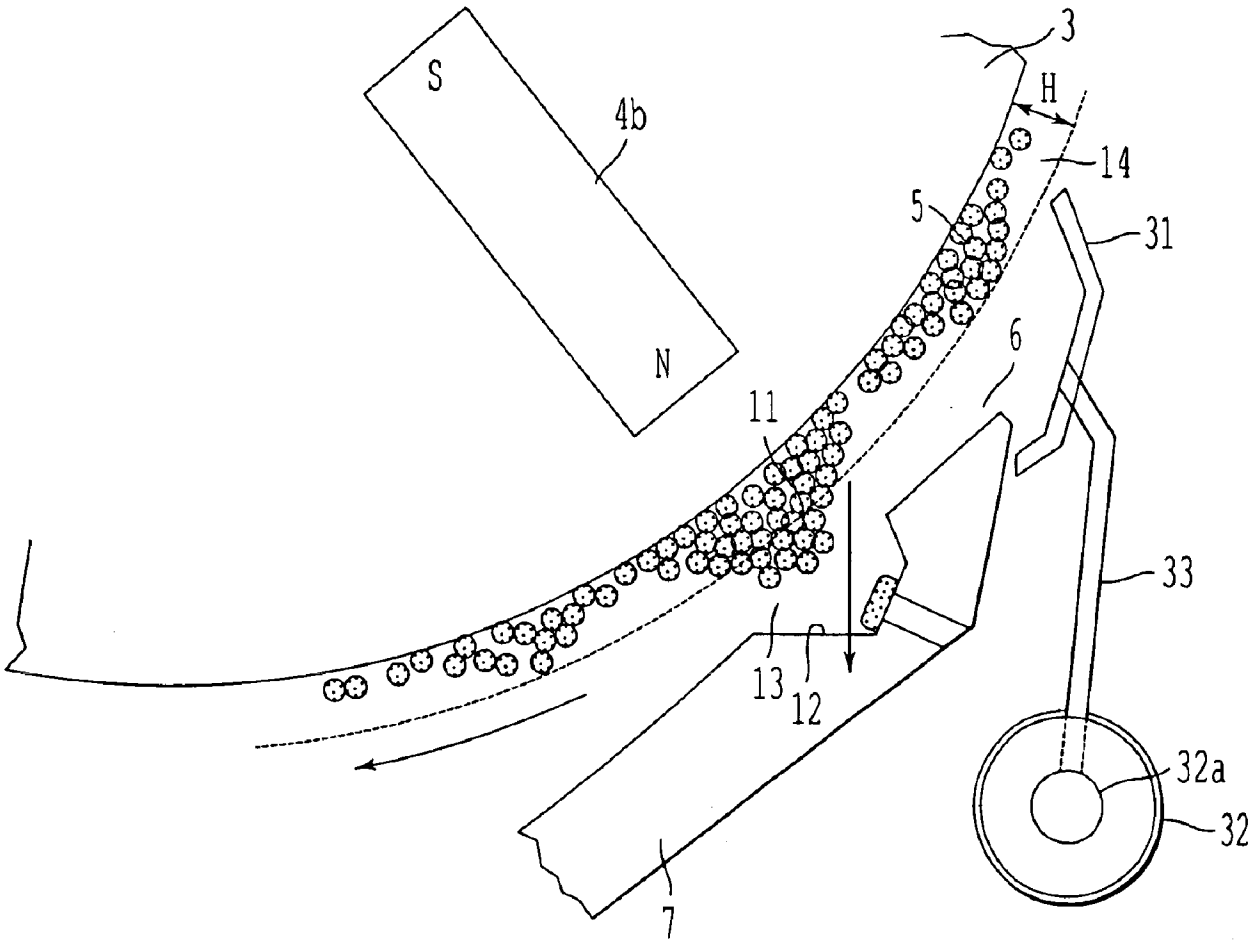
FIG. 11 is a cross-sectional front view of a developing part of a developing apparatus according to a third embodiment of the present invention.
Figure 12:
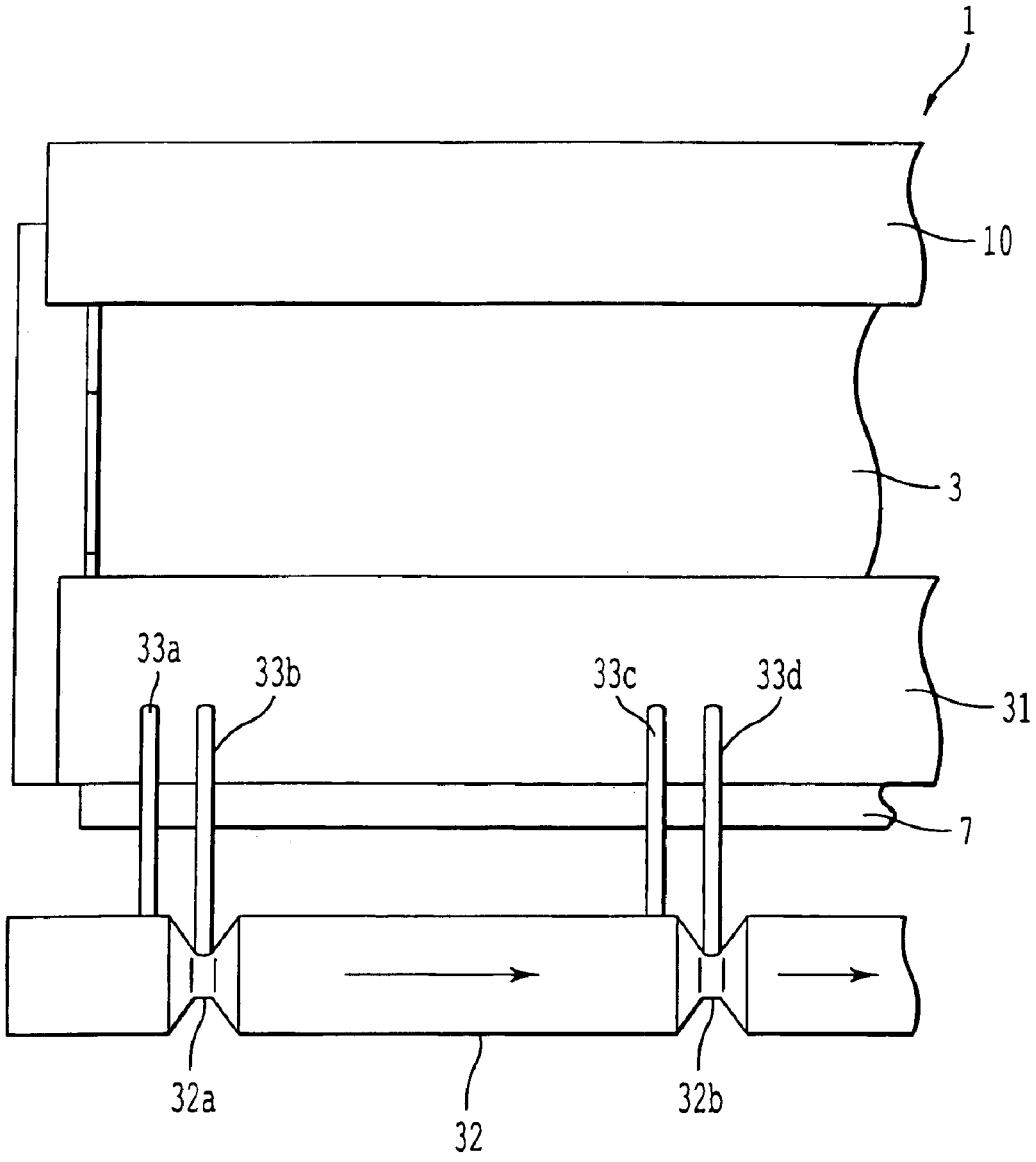
FIG. 12 is a cross-sectional side view of the developing part of the developing apparatus according to the third embodiment.

FIG. 11 is a cross-sectional front view of the developing apparatus according to the third embodiment, and FIG. 12 is a cross-sectional side view thereof.

In addition to components of the developing apparatus according to the first embodiment, the developing apparatus 1 has a splashing toner inhaling cover 31, a splashing toner inhaling duct 32 and a plurality of narrow parts 32*a*, 32*b* as shown in FIG. 11 and FIG. 12. At the outlet of outward airflows as illustrated in FIG. 11, the splashing toner inhaling cover 31 is disposed to closely face the circumferential surface of the developing sleeve 3 at the downstream side from the permanent magnet 4*a* with respect to the rotational direction of the developing sleeve 3. Additionally, the splashing toner inhaling duct 32 as illustrated in FIG. 12 is disposed beneath the splashing toner inhaling cover 31 along the horizontal direction and parallel to the axial direction of the developing sleeve 3. The splashing toner inhaling duct 32 has a diameter of about 10 mm and is connected to a ventilator, which is not illustrated, such as an axial fan to flow air in a predetermined direction. The plurality of narrow parts 32*a*, 32*b* make the duct size of the splashing toner inhaling duct 32 narrower. Furthermore, a plurality of pressure inlet pipes 33*a*, 33*b*, 33*c*, 33*d* are disposed to communicate between the splashing toner inhaling cover 31 and the narrow parts 32*a*, 32*b* and other positions of the splashing toner inhaling duct 32 as illustrated in FIG. 12. The splashing toner inhaling cover 31 and the splashing toner inhaling duct 32 have at least the same lengths as the total length of the developing sleeve 3.

Since the developing unit casing 7 fundamentally has the concave structure 15 forming the concave part 12, it is possible to reduce abnormal outlet airflows from the interior of the developing unit casing 7 as mentioned above. However, it is impossible to completely suppress the outward airflows. According to the developing apparatus 1, since the splashing toner inhaling duct 32, which requires a small installation space, is disposed at points where the outward airflows are generated, it is possible to with greater assurance collect the splashing toner and the splashing carrier.

The splashing toner inhaling duct 32, where an air flows in the predetermined direction, includes the narrow parts 32*a*, 32*b* of smaller diameters. When the pressure inlet pipes 33*b*, 33*d* are connected to the respective narrow parts 32*a*, 32*b* of the smaller diameters and the pressure inlet pipes 33*a*, 33*c* are connected to the splashing toner inhaling duct 32 of the greater diameter, the inner pressure of the pressure inlet pipes 33*b*, 33*d* becomes lower than that of the pressure inlet pipes 33*a*, 33*c*. For this reason, the pressure inlet pipes 33*b*, 33*d* are disposed to communicate between the respective narrow parts 32*a*, 32*b* and positions of the splashing toner inhaling cover 31 where more splashing toner and more splashing carrier are empirically estimated to be generated with respect to the major axial direction, and the pressure inlet pipes 33*a*, 33*c* are disposed to communicate between the splashing toner inhaling duct 32 and positions near the connection points of the pressure inlet pipes 33*b*, 33*c* as illustrated in FIG. 12. As a result, it is possible to effectively inhale (drain) the splashing toner and the splashing carrier into the splashing toner inhaling duct 32. As mentioned above, it is empirically known that there is a distribution of splashing of toner and carrier, that is, more toner and more carrier are generated at certain points. Although, for example, more toner and carrier are likely to splash at end parts of the developing apparatus 1 and rib parts of the developing unit casing 7, the generation mechanism of such a distribution has not been made clear.

In such configuration, the additional parts, that is, the splashing toner inhaling cover 31, the splashing toner inhaling duct 32, the narrow parts 32*a*, 32*b* and the pressure inlet pipes 33*a*, 33*b*, 33*c*, 33*d* do not fundamentally occupy large spaces in the developing apparatus 1, because the splashing toner inhaling duct 32 has a thin cylindrical shape and the pressure inlet pipes 33*a*, 33*b*, 33*c*, 33*d* are formed of pipes whose diameters have certain flexibility. Also, when the narrow parts 32*a*, 32*b* are appropriately installed, it is possible to increase inhaling force (draining capacity) at an arbitrary point and locally prevent splashing of toner and carrier.

Bernoulli's law asserts that the sum of energy of dynamic pressure and potential energy of static pressure in the same flow line is constant. Since the amount of flowing air is constant for any cross-section of the splashing toner inhaling duct 32, it is possible to change the flow speed of the air, that is, the dynamic pressure of the air, by changing the diameter of the splashing toner inhaling duct 32. Additionally, if the splashing toner inhaling duct 32 is positioned so that its flow direction is parallel to the gravitational direction, the static pressure varies. Here, when the splashing toner inhaling duct 32, whose diameter is 10 mm, is used and the resulting splashing toner inhaling duct 32 is properly connected to the pressure inlet pipes 33*a*, 33*b*, 33*c*, 33*d*, each of which has a diameter of 2 mm, by changing the diameters individually in a range of between ⅛ and double, it is estimated that the air flows in the splashing toner inhaling duct 32 at the flow speed of about 0.2 m/s even if an ordinary axial f is used.

A description will now be given, with reference to FIG. 13, of a developing apparatus 1 according to the fourth embodiment of the present invention wherein the same parts as those of the developing apparatuses according to the previous embodiments are designated by the same reference numerals and a description thereof is omitted.

Based on the fact that more toner and more carrier are likely to splash at axial ends of the developing sleeve 3, the shape of the splashing toner inhaling duct 32 and the connection points of the pressure inlet pipes 33*a*, 33*b*, 33*c*, 33*d* are improved to effectively collect the toner and the carrier that are more likely to splash at the axial ends of the developing sleeve 3.

Figure 13:
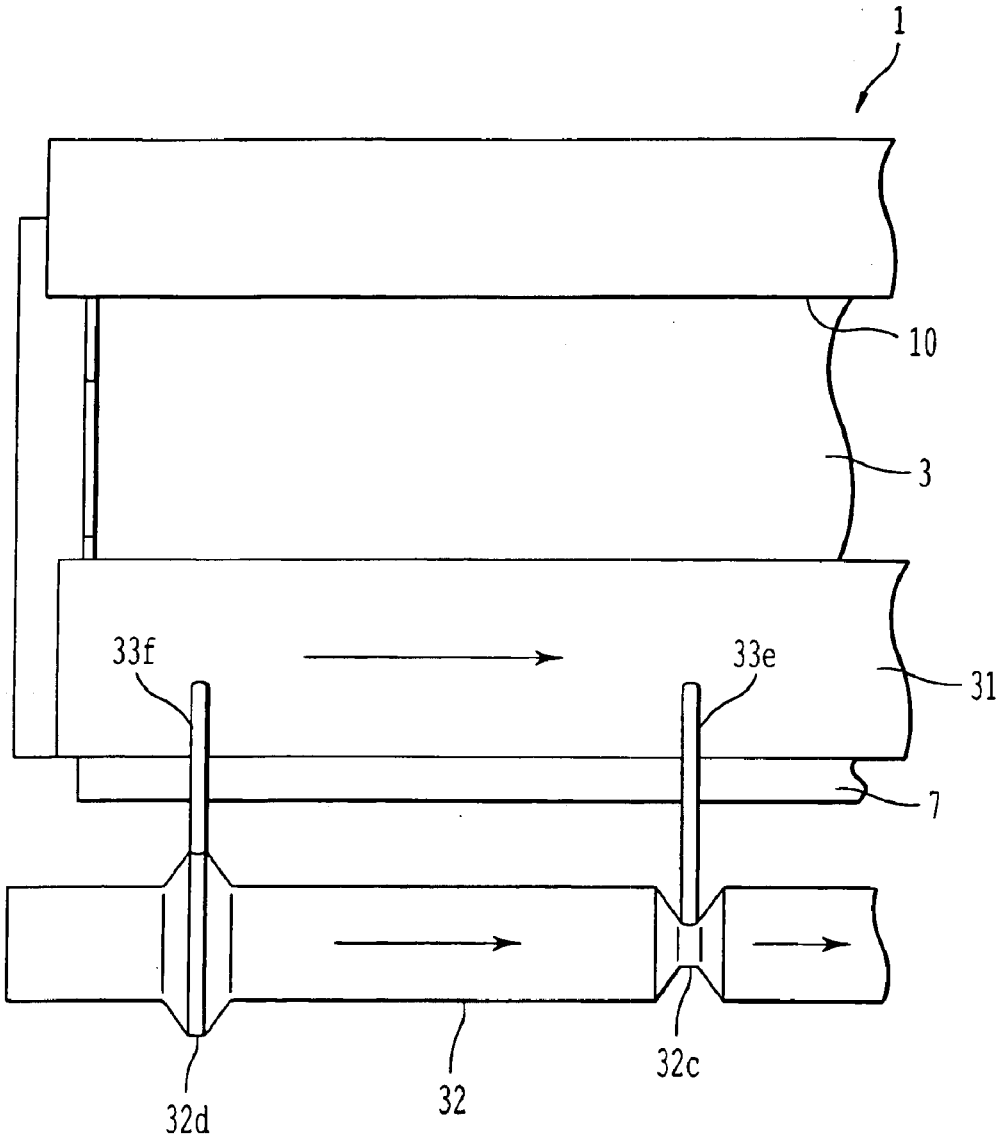
FIG. 13 is a cross-sectional side view of a developing part of a developing apparatus according to a fourth embodiment of the present invention.

FIG. 13 is a cross-sectional side view of the developing apparatus 1 according to the fourth embodiment.

Referring to FIG. 13, a pressure inlet pipe 33*e* is disposed to communicate between a middle position of the splashing toner inhaling cover 31 with respect to the axial direction of the developing sleeve 3 and the narrow part 32*c* of the splashing toner inhaling duct 32. Additionally, a pressure inlet pipe 33*f* is disposed to communicate between an end region of the splashing toner inhaling cover 31 with respect to the axial direction of the developing sleeve 3 and a thick part 32*d* of the splashing toner inhaling duct 32. The'splashing toner inhaling duct 32 has a greater diameter at the thick part 32*d*.

When the developing apparatus 1 has such a structure, the air flows in the splashing toner inhaling cover 31 from the end region to the middle region, as illustrated by the arrow in FIG. 13, depending on pressure differences between the narrow part 32*c* and the thick part 32*d*. Consequently, toner and carrier splashing at the end region are carried on the airflow to the middle region of the splashing toner inhaling cover 31. The toner and the carrier are carried in the splashing toner inhaling duct 32 via the pressure inlet pipe 33*e* and the narrow part 32*c*.

In general, it is preferable that the pressure inlet pipes 33 (FIG. 11) have small diameters so that the developing apparatus 1 can be flexibly designed. However, the installation of the pressure inlet pipes 33 entails the loss of pressure. Thus, even if the number of the pressure inlet pipes 33 is increased, the developing apparatus 1 does not necessarily prevent splashing of toner and carrier more effectively in proportion to the increase in the pressure inlet pipes 33. Furthermore, the increase in the pressure inlet pipes 33 may bring about adverse effects, for example, the loss of design flexibility. According to the developing apparatus 1, however, it is possible to effectively inhale (drain) toner and carrier splashing at the end region by using the minimal pressure inlet pipes 33.

A description will now be given, with reference to FIG. 14, of a developing apparatus 1 according to the fifth embodiment of the present invention wherein the same parts as those of the developing apparatuses according to the previous embodiments are designated by the same reference numerals and a description thereof is omitted.

Figure 14:
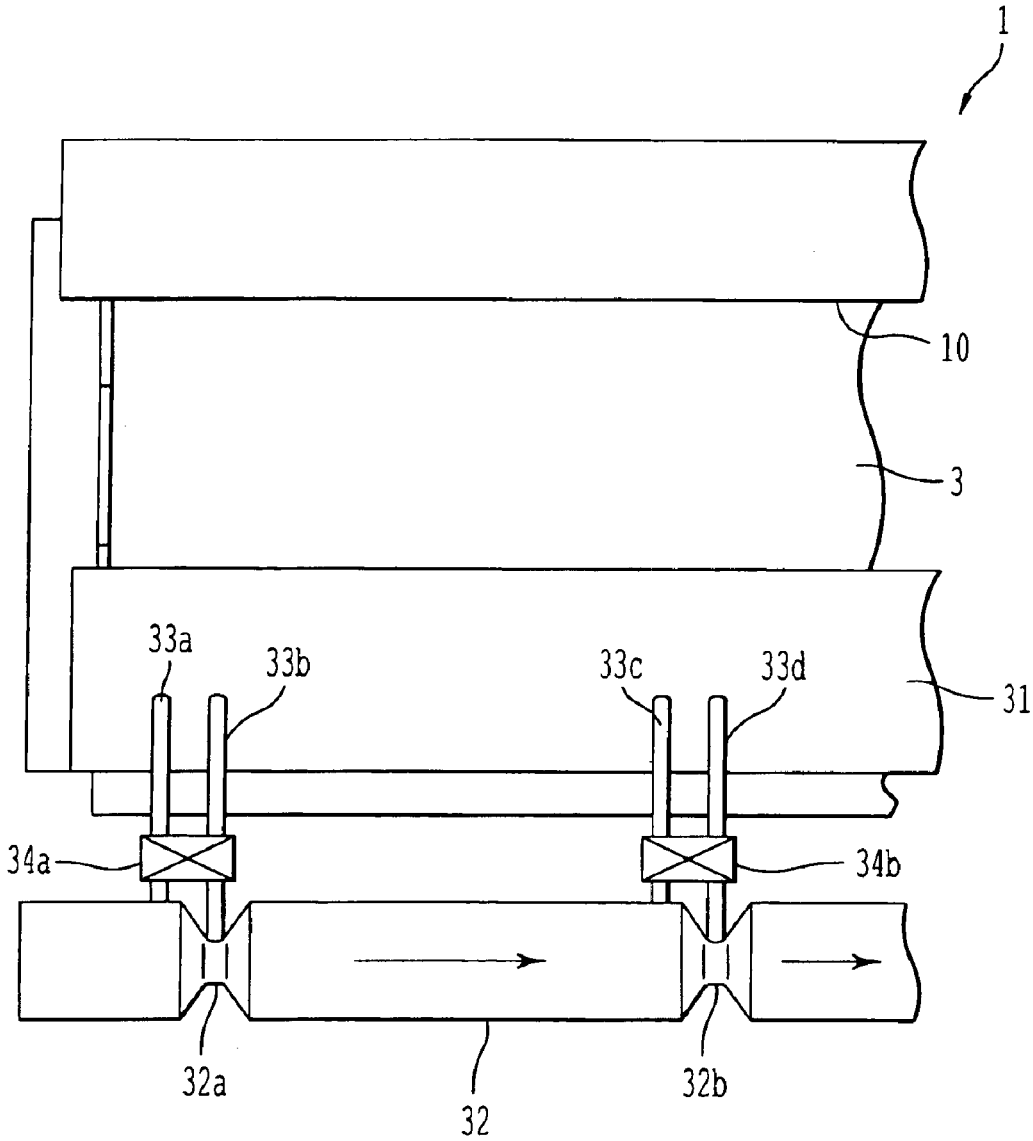
FIG. 14 is a cross-sectional side view of a developing part of a developing apparatus according to a fifth embodiment of the present invention.

FIG. 14 is a cross-sectional side view of the developing apparatus 1 according to the fifth embodiment. Referring to FIG. 14, the developing apparatus 1 includes interruption switches 34*a*, 34*b* in addition to the structure of the developing apparatus according to the third embodiment. The interruption switches 34*a*, 34*b* as illustrated in FIG. 14 are disposed in the courses of the pressure inlet pipes 33*a*, 33*b*, 33*c*, 33*d* so as to enable users and maintenance workers to interrupt the flow in the pressure inlet pipes 33*a*, 33*b*, 33*c*, 33*d*.

If an image forming apparatus including the developing apparatus 1, for example, a copier, is used more heavily than the average work load thereof, specifically, if the image forming apparatus is more frequently operated or is used in a way quite different from the normal usage, there is a risk that the inner conditions of the developing apparatus 1 may undergo wide variation. For instance, the image forming apparatus handles papers of different sizes, resulting in a temperature distribution in the interior of the photoconductor 2 Also, when the image forming apparatus is used for a long time period, a temperature distribution can arise in the interior of the developing apparatus 1 due to thermal conduction of other units thereof such as a fusing apparatus. Since airflow is highly sensitive to such environmental variations, there is a risk that the air does not flow in the narrow parts 32*a*, 32*b* of the splashing toner inhaling duct 32 in accordance with expectation. However, when the interruption switches 34*a*, 34*b* are mounted on the pressure inlet pipes 33*a*, 33*b*, 33*c*, 33*d*, the image forming apparatus can be easily operated to eliminate the above-mentioned problem. If users and maintenance workers appropriately interrupt communications between the splashing toner inhaling duct 32 and the splashing toner inhaling cover 31 via the individual pressure inlet pipes 33*a*, 33*b*, 33*c*, 33*d* by means of the interruption switches 34*a*, 34*b* it is possible to adjust the amount of outward airflows even after the image forming apparatus has been installed.

Figure 2:
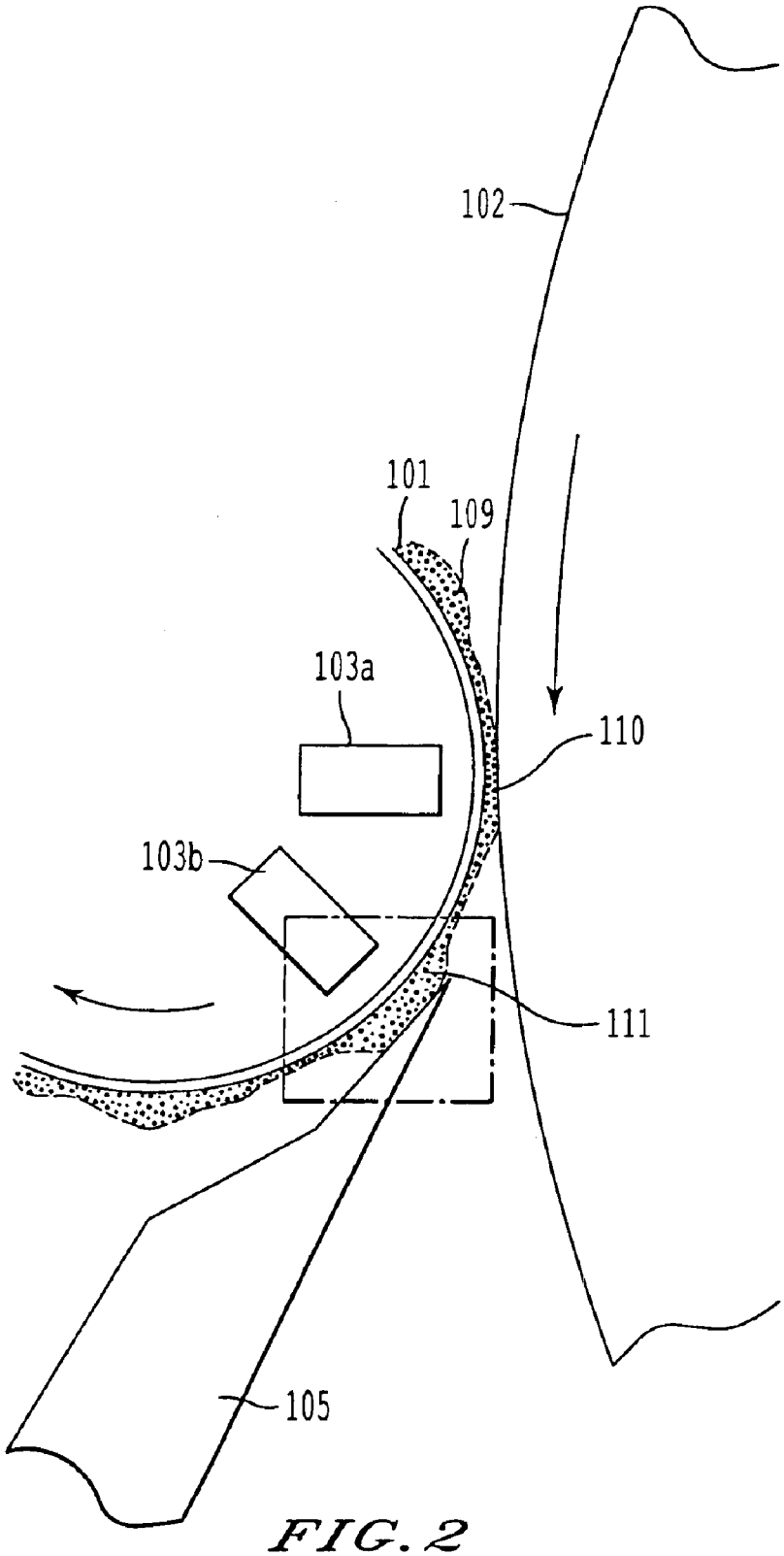
FIG. 2 PRIOR ART
FIG. 2 is an enlarged cross-sectional front view of a developing part of the conventional magnetic brush development type developing apparatus in FIG. 1.
Figure 3:
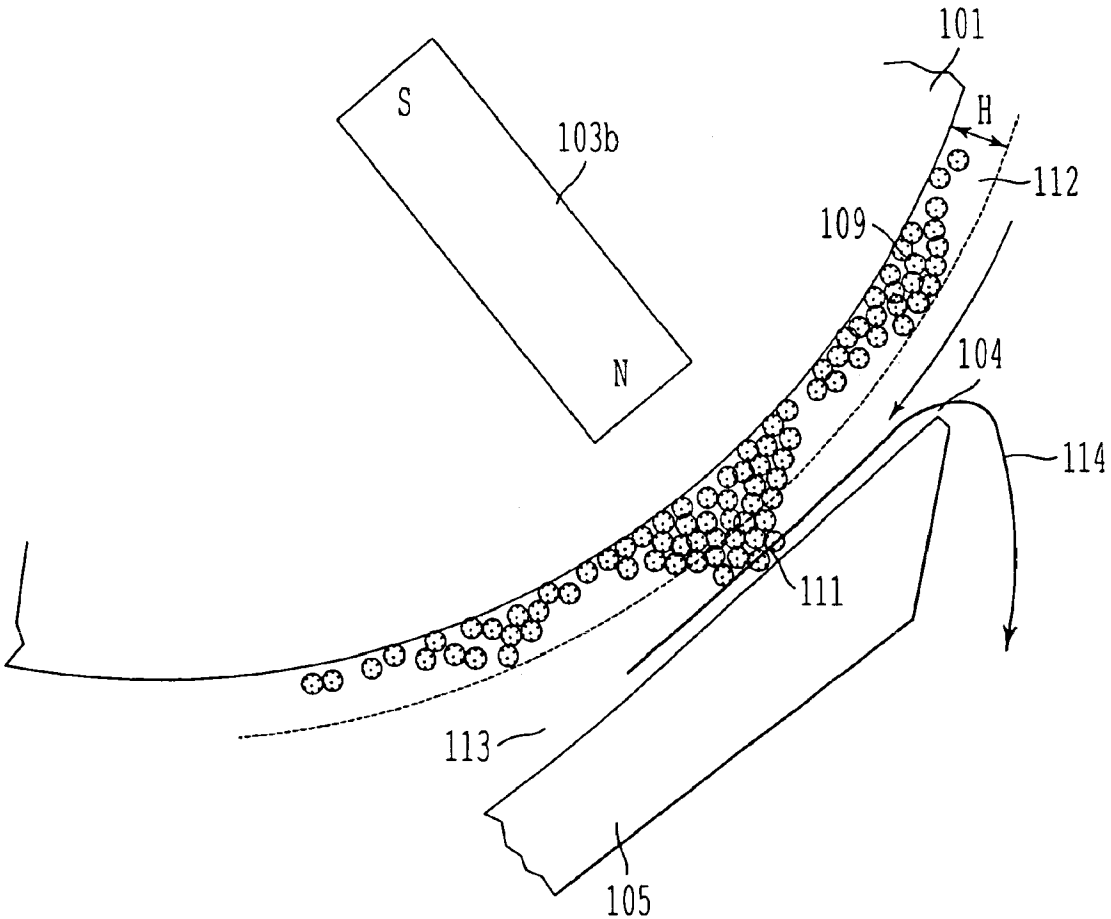
FIG. 3 PRIOR ART
FIG. 3 is a cross-sectional front view of the developing part of the conventional magnetic brush development type developing apparatus in FIG. 1 for explaining an outward airflow around an aperture of a developing unit casing.

The developing apparatuses according to the third embodiment through the fifth embodiment adopt the developing unit casing 7 having the concave structure 15 forming the concave part 12. However, the developing apparatuses are also applicable to the conventional developing unit casing 105 as illustrated in FIG. 2, that is, the developing unit casing 105 without the concave structure 15 forming the concave part 12. Even in this case, since splashing toner and others due to outward airflows can be reliably collected in the splashing toner inhaling duct 32, it is possible to overcome the toner splashing problem.

A description will now be given, with reference to FIG. 15, of a developing apparatus 1 according to the sixth embodiment of the present invention wherein the same parts as those of the developing apparatuses according to the previous embodiments are designated by the same reference numerals and a description thereof is omitted.

Figure 15:
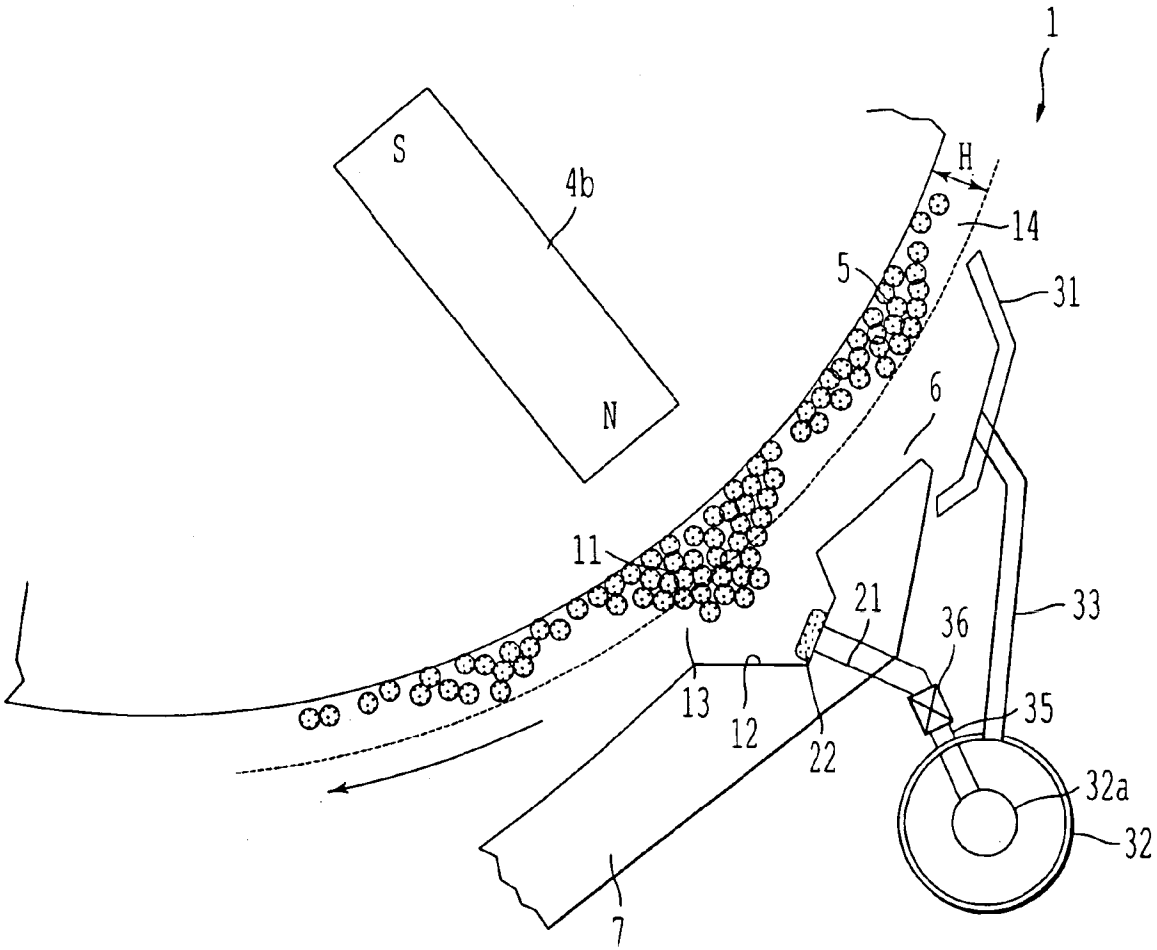
FIG. 15 is a cross-sectional front view of a developing part of a developing apparatus according to a sixth embodiment of the present invention.

FIG. 15 is a cross-sectional front view of a developing apparatus 1 according to the sixth embodiment. The developing apparatus 1 is devised based on the developing apparatuses according to the second embodiment through the fifth embodiment. A second pressure inlet pipe 35 and a second interruption switch 36 are provided in the developing apparatus 1. The second pressure inlet pipe 35 communicates between the passage 21 and the narrow part 32*a* in the splashing toner inhaling duct 32. The second interruption switch 36 serves as a switch for interrupting the communication via the second pressure inlet pipe 35. The second interruption switch 36 is set in a closed condition during normal use.

According to the developing apparatus 1, if an operator changes the condition of the second interruption switch 36 during idle time of the developing apparatus 1, for example, at startup time of an image forming apparatus including the developing apparatus 1, so as to make the communication via the second pressure inlet pipe 35 available, the communication between the passage 21 and the narrow part 32*a* is made available and the pressure in the low pressure area 13 of the developing unit casing 7 becomes positive relative to the atmosphere. As a result, it is possible to compulsorily cause outward airflows. Then, the outward airflows remove toner and carrier accumulated on the porous breathable sheet 22. The removed toner and carrier are reliably collected in the splashing toner inhaling duct 32 through the splashing toner inhaling cover 31 and the pressure inlet pipe 33. Therefore, it is possible to prevent the toner and the carrier accumulated on the porous breathable sheet 22 from floating in the interior of the developing apparatus 1 and splashing to the exterior thereof.

A description will now be given, with reference to FIG. 16 and FIG. 17, of a tandem type full-color image forming apparatus according to the seventh embodiment of the present invention wherein the above-mentioned developing apparatus 1 is installed.

Figure 16:
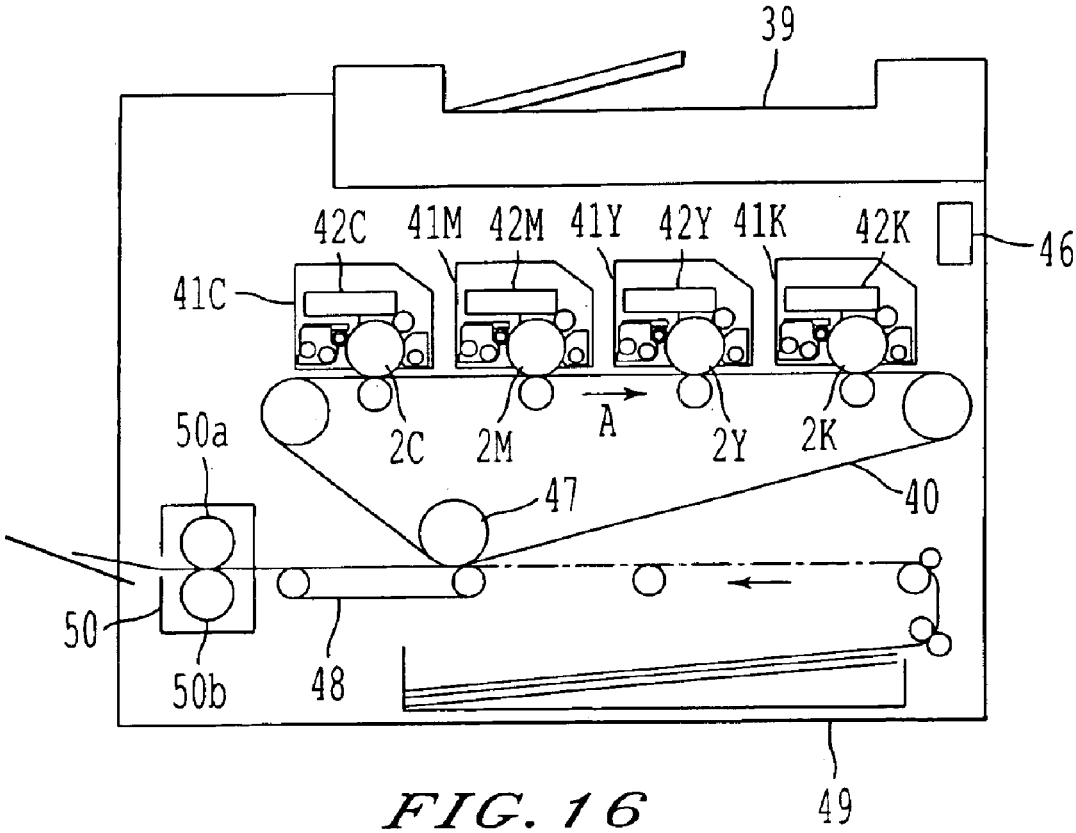
FIG. 16 is a cross-sectional front view of a tandem type full-color image forming apparatus according to a seventh embodiment of the present invention.
Figure 17:
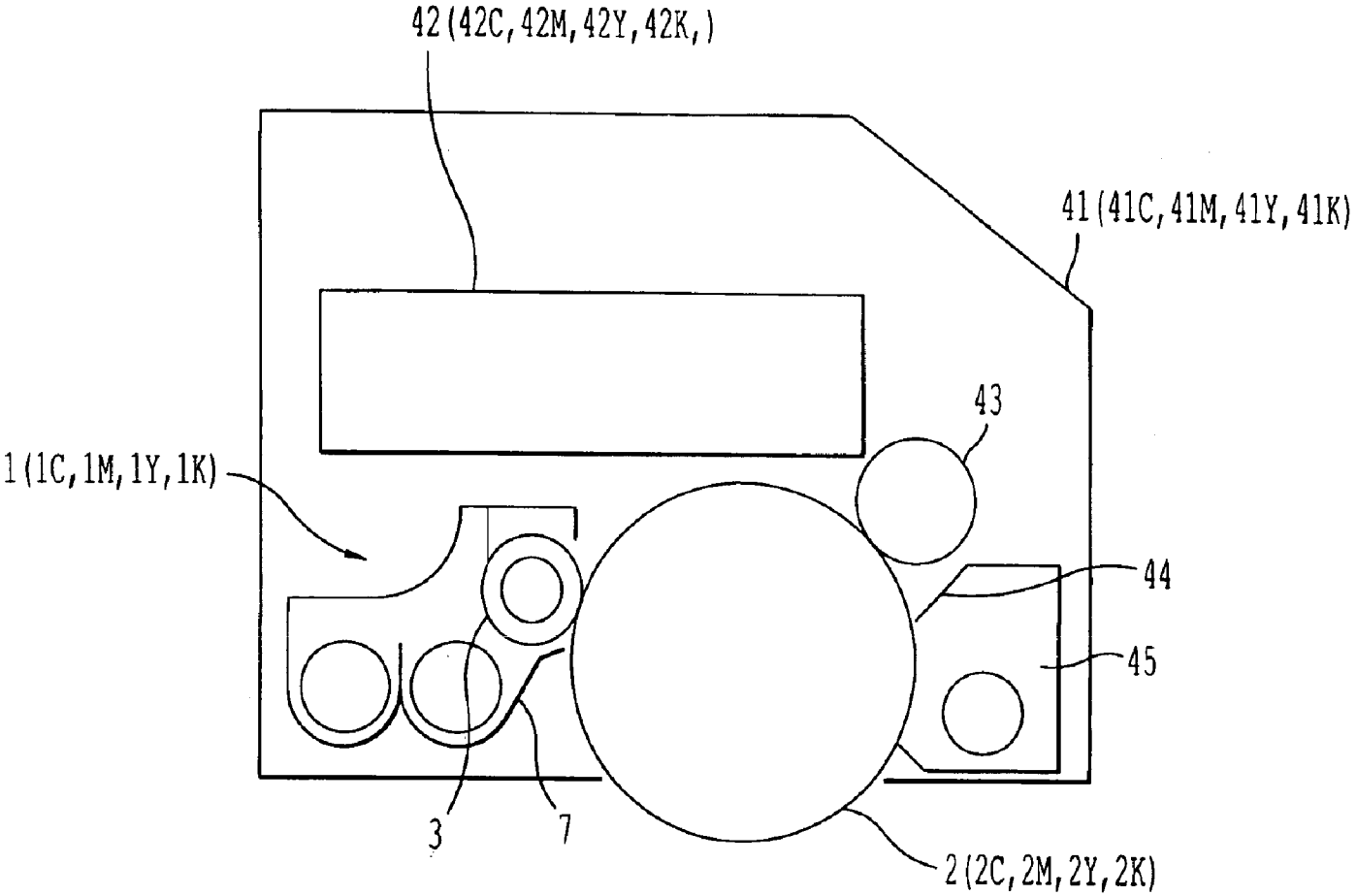
FIG. 17 is an enlarged cross-sectional front view of an image forming unit of the tandem type full-color image forming apparatus in FIG. 16.

FIG. 16 is a cross-sectional front view of the tandem type full-color image forming apparatus according to the seventh embodiment, and FIG. 17 is an enlarged cross-sectional front view of an image forming unit of the tandem type full-color image forming apparatus.

Referring to FIG. 16, image forming units 41C, 41M, 41Y and 41K are arranged along on an intermediate transfer belt 40. The image forming units 41C, 41M, 41Y and 41K, each of which has a mutually similar structure, form a toner image composed of respective four colors: cyan (C), magenta (M), yellow (Y) and black (K) on the intermediate transfer belt 40 serving as a second image carrying member. The image forming units 41C, 41M, 41Y and 41K integrally comprise photoconductors 2C, 2M, 2Y and 2K and developing apparatuses 1C, 1M, 1Y and 1K, and optical writing parts 42C, 42M, 42Y and 42K, respectively. The photoconductors 2C, 2M, 2Y and 2K and developing apparatuses 1C, 1M, 1Y and 1K serve as constituents of process parts of the image forming units 41C, 41M, 41Y and 41K, respectively. On the other hand, the optical writing parts 42C, 42M, 42Y and 42K comprise semiconductor lasers for optically writing individual latent images on the respective photoconductors 2C, 2M, 2Y and 2K, a polygon minor and an fθ lens. As shown in FIG. 17, the process parts of the image forming units 41C, 41M, 41Y and 41K additionally include individual electrifying rollers 43 and cleaning apparatuses 45. The electrifying rollers 43 uniformly electrify the circumferential surfaces of the respective photoconductors 2C, 2M, 2Y and 2K. The cleaning apparatuses 45 have cleaning blades 44 for scraping residual toner away from the respective photoconductors 2C, 2M, 2Y and 2K in accordance with necessity. As shown in FIG. 16, the image forming apparatus also has a scanner 39 for reading manuscripts and images.

In the image forming apparatus, the optical writing parts 42C, 42M, 42Y and 42K irradiate writing beams corresponding to writing signals on the photoconductors 2C, 2M, 2Y and 2K of the image forming units 41C, 41M, 41Y and 41K, respectively, based on reading signals from the scanner 39. The image forming units 41C, 41M, 41Y and 41K form individual color toner images on the photoconductors 2C, 2M, 2Y and 2K, respectively, corresponding to the writing signals, and then the individual color toner images are sequentially transferred onto the intermediate transfer belt 40. In order to form a full-color image, it is necessary to properly superpose the individual color toner images on the intermediate transfer belt 40. For this reason, a controller 46 is used to adjust writing timings of the optical writing parts 42C, 42M, 42Y and 42K.

After the full-color image is formed on the intermediate transfer belt 40 as a toner image, the toner image is transported in the direction indicated by the arrow A in FIG. 16 through rotational movement of the intermediate transfer belt 40. During the movement, a transferred member, which comprises a recording medium such as a transferred paper and an OHP (Overhead Projector) sheet, is delivered from a paper tray 49 to a nip part between a transfer roller 47 and a carrying belt 48. The transfer roller 47 is one of a plurality of rollers for tensioning the intermediate transfer belt 40 in a state where the intermediate transfer belt 40 can be rotated freely, and the carrying belt 48 is disposed to face the transfer roller 47 such that the intermediate transfer belt 40 is sandwiched between the carrying belt 48 and the transfer roller 47. Here, the transferred member is fed at such timing that an edge of an image transferred region an the transferred member coincides with an edge of the toner image transferred on the intermediate transfer belt 40.

When the transferred member passes through the nip part, the toner image on the intermediate transfer belt 40 is transferred onto the transferred member. Thereafter, the toner on the transferred member is fused by a heat roller 50*a* and a pressure roller 50*b* of a fusing apparatus 50, and then the resulting transferred member is provided to the exterior of the image forming apparatus as an output thereof.

In the image forming apparatus, the image forming units 41C, 41M, 41Y and 41K are arranged along the intermediate transfer belt 40. If toner or carrier falls or splashes from the image forming units 41C, 41M, 41Y and 41K to the intermediate transfer belt 40, the toner or the carrier may appear as spots on a toner image transferred thereon and the resulting image may have degraded image quality. However, since the image forming units 41C, 41M, 41Y and 41K adopt the respective developing apparatuses 1C, 1M, 1Y and 1K according to the present invention, that is, the developing apparatuses capable of preventing toner splashes and carrier splashes by using the concave structure 15 of the developing unit casing 7, the splashing toner inhaling duct 32 and other components as mentioned previously, there is no risk of the toner image on the intermediate transfer belt 40 being damaged by spots due to splashing of the toner and the carrier. As a result, it is possible to prevent degradation of image quality due to the splashing of toner and carrier.

In the above description of the image forming apparatus according to the seventh embodiment, the developing apparatuses 1C, 1M, 1Y and 1K and the photoconductors 2C, 2M, 2Y and 2K are integrated in the image forming units 41C, 41M, 41Y and 41K, respectively. However, it is not necessary to integrate the developing apparatuses 1C, 1M, 1Y and 1K and the photoconductors 2C, 2M, 2Y and 2K in the image forming units 41C, 41M, 41Y and 41K, respectively. The image forming apparatus may have such a structure that the developing apparatuses 1C, 1M, 1Y and 1K are disposed separately from the photoconductors 2C, 2M, 2Y and 2K, respectively. Also, it is not necessary to include the optical writing parts 42C, 42M, 42Y and 42K in the image forming units 41C, 41M, 41Y and 41K integrally as single units, respectively. The image forming apparatus may have such a structure that the optical writing parts 42C, 42M, 42Y and 42K are disposed separately from the image forming units 41C, 41M, 41Y and 41K.

In this embodiment, the image forming apparatus is described as a tandem type full-color copier and the individual color toner images on the photoconductors 2C, 2M, 2Y and 2K are transferred on the intermediate transfer belt 40. However, the image forming apparatus may have such a structure that the individual color toner images on the photoconductors 2C, 2M, 2Y and 2K are sequentially transferred directly onto a transferred member carried on the intermediate transfer belt 40.

Additionally, although the image forming apparatus according to the present invention is allied with the tandem type full-color copier, the image forming apparatus is applicable to an ordinary monochrome image forming apparatus, for example, a monochrome copier, a laser printer and a facsimile apparatus.

The present invention is not limited to the specifically disclosed embodiments, and variations and modifications may be made without departing from the scope of the present invention.

The present application is based on Japanese priority application No. 2002-173876 filed Jun. 14, 2002, the entire contents of which are hereby incorporated by reference.

What is claimed is:

1. A developing apparatus for developing a latent image on a latent image carrying member with a magnetic brush made of developer comprising toner and magnetic carrier, comprising:

a developer carrying member being rotated in a state where said magnetic brush is being formed thereon so as to develop said latent image;

a first permanent magnet being built in said developer carrying member at a fixed position facing said latent image carrying member, said first permanent magnet serving as a main pole and generating a magnetic field of said main pole so as to form a first magnetic brush of the developer on said developer carrying member;

a developing unit casing covering said developer carrying member, said developing unit casing having an aperture to expose said developer carrying member at the position facing said latent image carrying member; and a second permanent magnet being built in said developer carrying member at a fixed position near said aperture at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member, wherein said developing unit casing has a concave structure to form a low pressure area at a position facing said second permanent magnet, and said concave structure is concave toward an extension of said second magnetic brush so as to have a larger gap there between said developer carrying member and said developing unit casing than a gap at a tip part of said aperture between said developer carrying member and said latent image carrying member.

2. The developing apparatus as claimed in claim 1, wherein said concave structure comprises a concave part formed on an inner surface of said developing unit casing at a position facing said second permanent magnet.

3. The developing apparatus as claimed in claim 1, wherein said concave structure comprises a curvature of said developing unit casing.

4. The developing apparatus as claimed in claim 1, wherein at said position facing the second permanent magnet, a distance between a surface of said developer carrying member and a bottom of said concave structure is greater than or equal to a height of said second magnetic brush.

5. The developing apparatus as claimed in claim 1, wherein said developing unit casing has a passage to communicate between said low pressure area and an exterior of said developing unit casing through a porous breathable sheet.

6. The developing apparatus as claimed in claim 5, wherein said porous breathable sheet comprises a high-density polyethylene nonwoven fabric sheet.

7. The developing apparatus as claimed in claim 5, wherein said porous breathable sheet is disposed such that a surface thereof is not orthogonal to a gravitational direction.

8. The developing apparatus as claimed in claim 5, further comprising a splashing toner inhaling cover being disposed close to said developer carrying member at a downstream side from said first permanent magnet with respect to a rotational direction of said developer carrying member, adjacent to said aperture of the developing unit casing, a splashing toner inhaling duct being disposed at a downstream position from said splashing toner inhaling cover along an axial direction of said developer carrying member and being connected to a ventilator so that air flows in a predetermined direction through said splashing toner inhaling duct, said splashing toner inhaling duct including a narrow part having a smaller diameter, and a plurality of pressure inlet pipes communicating between said splashing toner inhaling duct and said splashing toner inhaling cover at a plurality of positions including a position of said narrow part.

9. The developing apparatus as claimed in claim 8, further comprising a second pressure inlet pipe communicating between said narrow part of the splashing toner inhaling duct and said passage, and an interrupting part interrupting communication between said splashing toner inhaling duct and said passage.

10. The developing apparatus as claimed in claim 1, further comprising a splashing toner inhaling cover being disposed close to said developer carrying member at a downstream side from said first permanent magnet with respect to a rotational direction of said developer carrying member, adjacent to said aperture of the developing unit casing, a splashing toner inhaling duct being disposed at a downstream position from said splashing toner inhaling cover along an axial direction of said developer carrying member and being connected to a ventilator so that air flows in a predetermined direction through said splashing toner inhaling duct, said splashing toner inhaling duct including a narrow part having a smaller diameter, and a plurality of pressure inlet pipes communicating between said splashing toner inhaling duct and said splashing toner inhaling cover at a plurality of positions including a position of said narrow part.

11. A developing apparatus for developing a latent image on a latent image carrying member with a magnetic brush made of developer comprising toner and magnetic carrier, comprising:

a developer carrying member being rotated in a state where said magnetic brush is being formed thereon so as to develop said latent image;

a first permanent magnet being built in said developer carrying member at a fixed position facing said latent image carrying member, said first permanent magnet serving as a main pole and generating a magnetic field of said main pole so as to form a first magnetic brush of the developer on said developer carrying member;

a developing unit casing covering said developer carrying member, said developing unit casing having an aperture to expose said developer carrying member at the position facing said latent image carrying member;

a second permanent magnet being built in said developer carrying member at a fixed position at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member;

a splashing toner inhaling cover being disposed close to said developer carrying member at a downstream side from said first permanent magnet with respect to a rotational direction of said developer carrying member, adjacent to said aperture of the developing unit casing;

a splashing toner inhaling duct being disposed below said splashing toner inhaling cover along an axial direction of said developer carrying member and being connected to a ventilator so that air flows in a predetermined direction through said splashing toner inhaling duct, said splashing toner inhaling duct including a narrow part having a smaller diameter; and a plurality of pressure inlet pipes communicating between said splashing toner inhaling duct and said splashing toner inhaling cover at a plurality of positions including a position of said narrow part.

12. The developing apparatus as claimed in claim 11, wherein at least one of said pressure inlet pipes communicates between a position of said splashing toner inhaling cover to which one of the toner and the magnetic carrier on said developer carrying member is likely to splash and said narrow part of the splashing toner inhaling duct.

13. The developing apparatus as claimed in claim 11, wherein at least one of said pressure inlet pipes communicates between a middle position of said splashing toner inhaling cover with respect to the axial direction of said developer carrying member and said narrow part of the splashing toner inhaling duct and at least one of said pressure inlet pipes communicates between an end position of said splashing toner inhaling cover with respect to the axial direction of said developer carrying member and a thick part of said splashing toner inhaling duct whose diameter is greater.

14. The developing apparatus as claimed in claim 11, wherein each of said pressure inlet pipes includes a first interrupting part separately interrupting communication between said splashing toner inhaling cover and said splashing toner inhaling duct.

15. An image forming unit, comprising:

a latent image carrying member on which a latent image is formed; and a developing apparatus developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; and a second permanent magnet being built in said developer carrying member at a fixed position near said aperture at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member, wherein said developing unit casing has a concave structure to form a low pressure area at a position facing said second permanent magnet, and said concave structure is concave toward an extension of said second magnetic brush so as to have a larger gap there between said developer carrying member and said developing unit casing than a gap at a tip part of said aperture between said developer carrying member and said latent image carrying member.

16. An image forming unit, comprising:

a latent image carrying member on which a latent image is formed; and a developing apparatus developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; a second permanent magnet being built in said developer carrying member at a fixed position at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member, a splashing toner inhaling cover being disposed close to said developer carrying member at a downstream side from said first permanent magnet with respect to a rotational direction of said developer carrying member, adjacent to said aperture of the developing unit casing; a splashing toner inhaling duct being disposed below said splashing toner inhaling cover along an axial direction of said developer carrying member and being connected to a ventilator so that air flows in a predetermined direction through said splashing toner inhaling duct, said splashing toner inhaling duct including a narrow part having a smaller diameter; and a plurality of pressure inlet pipes communicating between said splashing toner inhaling duct and said splashing toner inhaling cover at a plurality of positions including a position of said narrow part.

17. An image forming apparatus, comprising:

a latent image carrying member being rotationally driven;

an optical writing part forming a latent image on said latent image carrying member; and a developing apparatus being disposed near said latent image carrying member, said developing apparatus developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; and a second permanent magnet being built in said developer carrying member at a fixed position near said aperture at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member, wherein said developing unit casing has a concave structure to form a low pressure area at a position facing said second permanent magnet, and said concave structure is concave toward an extension of said second magnetic brush so as to have a larger gap there between said developer carrying member and said developing unit casing than a gap at a tip part of said aperture between said developer carrying member and said latent image carrying member.

18. The image forming apparatus as claimed in claim 17, further comprising a plurality of said latent image carrying members, a plurality of said developing apparatuses, and a tandem type image carrying member on which a plurality of developed images on respective said latent image carrying members are sequentially transferred.

19. An image forming apparatus, comprising:

a latent image carrying member being rotationally driven;

an optical writing part forming a latent image on said latent image carrying member; and a developing apparatus being disposed near said latent image carrying member, said developing apparatus for developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; a second permanent magnet being built in said developer carrying member at a fixed position at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member; a splashing toner inhaling cover being disposed close to said developer carrying member at a downstream side from said first permanent magnet with respect to a rotational direction of said developer carrying member, adjacent to said aperture of the developing unit casing; a splashing toner inhaling duct being disposed below said splashing toner inhaling cover along an axial direction of said developer carrying member and being connected to a ventilator so that air flows in a predetermined direction through said splashing toner inhaling duct, said splashing toner inhaling duct including a narrow part having a smaller diameter; and a plurality of pressure inlet pipes communicating between said splashing toner inhaling duct and said splashing toner inhaling cover at a plurality of positions including a position of said narrow part.

20. The image forming apparatus as claimed in claim 19, further comprising a plurality of said latent image carrying members, a plurality of said developing apparatuses, and a tandem type image carrying member on which a plurality of developed images on respective said latent image carrying members are sequentially transferred.

21. An image forming apparatus, comprising:

an image forming unit, comprising: a latent image carrying member on which a latent image is formed; and a developing apparatus developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; and a second permanent magnet being built in said developer carrying member at a fixed position near said aperture at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member; and an optical writing part forming said latent image on said latent image carrying member, wherein said developing unit casing has a concave structure to form a low pressure area at a position facing said second permanent magnet, and said concave structure is concave toward an extension of said second magnetic brush so as to have a larger gap there between said developer carrying member and said developing unit casing than a gap at a tip part of said aperture between said developer carrying member and said latent image carrying member.

22. The image forming apparatus as claimed in claim 21, further comprising a plurality of said latent image carrying members, a plurality of said developing apparatuses, and a tandem type image carrying member on which a plurality of developed images on respective said latent image carrying members are sequentially transferred.

23. An image forming apparatus, comprising:

an image forming unit, comprising: a latent image carrying member on which a latent image is formed; and a developing apparatus developing said latent image on said latent image carrying member with a magnetic brush made of developer comprising toner and magnetic carrier, comprising: a developer carrying member being rotated in a state where said magnetic brush is being formed thereon so as to develop said latent image; a first permanent magnet being built in said developer carrying member at a fixed position facing said latent image carrying member, said first permanent magnet serving as a main pole and generating a magnetic field of said main pole so as to form a first magnetic brush of the developer on said developer carrying member; a developing unit casing covering said developer carrying member, said developing unit casing having an aperture to expose said developer carrying member at the position facing said latent image carrying member; a second permanent magnet being built in said developer carrying member at a fixed position at a downstream side from said first permanent magnet with respect to a rotational direction of said developer carrying member, said second permanent magnet serving as an auxiliary pole and generating a magnetic field of said auxiliary pole so as to form a second magnetic brush of the developer on said developer carrying member; a splashing toner inhaling cover being disposed close to said developer carrying member at a downstream side from said first permanent magnet with respect to a rotational direction of said developer carrying member, adjacent to said aperture of the developing unit casing; a splashing toner inhaling duct being disposed below said splashing toner inhaling cover along an axial direction of said developer carrying member and being connected to a ventilator so that air flows in a predetermined direction through said splashing toner inhaling duct, said splashing toner inhaling duct including a narrow part having a smaller diameter; and a plurality of pressure inlet pipes communicating between said splashing toner inhaling duct and said splashing toner inhaling cover at a plurality of positions including a position of said narrow part; and an optical writing part forming said latent image on said latent image carrying member.

24. The image forming apparatus as claimed in claim 23, further comprising a plurality of said latent image carrying members, a plurality of said developing apparatuses, and a tandem type image carrying member on which a plurality of developed images on respective said latent image carrying members are sequentially transferred.

* * * * *